US011401716B2

(12) United States Patent
Love

(10) Patent No.: US 11,401,716 B2
(45) Date of Patent: Aug. 2, 2022

(54) ANCHORING SYSTEM FOR RAILING

(71) Applicant: Erik Love, Pointe-Claire (CA)

(72) Inventor: Erik Love, Pointe-Claire (CA)

( * ) Notice: Subject to any disclaimer, the term of this patent is extended or adjusted under 35 U.S.C. 154(b) by 286 days.

(21) Appl. No.: 16/472,348

(22) PCT Filed: Dec. 21, 2017

(86) PCT No.: PCT/CA2017/051579

§ 371 (c)(1),
(2) Date: Jun. 21, 2019

(87) PCT Pub. No.: WO2018/112652

PCT Pub. Date: Jun. 28, 2018

(65) Prior Publication Data

US 2019/0376296 A1 Dec. 12, 2019

Related U.S. Application Data

(60) Provisional application No. 62/492,611, filed on May 1, 2017, provisional application No. 62/524,173, filed on Jun. 23, 2017.

(30) Foreign Application Priority Data

Dec. 21, 2016 (CA) ..... 2952477

(51) Int. Cl.
*E04F 11/18* (2006.01)
*E01F 13/02* (2006.01)
(Continued)

(52) U.S. Cl.
CPC ..... *E04F 11/1812* (2013.01); *E01F 13/024* (2013.01); *E04G 5/14* (2013.01); *E04G 21/3223* (2013.01); *E04H 12/00* (2013.01)

(58) Field of Classification Search
CPC ..... E04F 11/1812; E01F 13/024; E04G 5/14; E04G 21/3223; E04H 12/00
(Continued)

(56) References Cited

U.S. PATENT DOCUMENTS 1,552,569 A * 9/1925 Schurman ..... E04F 11/1812 52/698
3,158,964 A * 12/1964 Haas ..... E04B 1/2612 411/39
(Continued)

FOREIGN PATENT DOCUMENTS

CH 442402 A * 8/1967 ..... E01F 9/60
CH 675893 A5 * 11/1990 ..... E04H 12/223
(Continued)

OTHER PUBLICATIONS

Translation for FR 2,300,868. (Year: 1976).*
(Continued)

*Primary Examiner* — Michael Safavi
(74) *Attorney, Agent, or Firm* — Hartman Global IP Law; Gary M. Hartman; Domenica N. S. Hartman

(57) ABSTRACT

An anchoring system for use with an erectable guiderail intended to be anchored with respect to a base surface. The anchoring system includes a female component being positioned and sized for lodging into a corresponding hole provided about the base surface and about which the guiderail is intended to be anchored, the female component defining an elongated cavity having a longitudinal axis. The anchoring system also includes a male component being operatively mountable onto a corresponding portion of the guiderail, the male component having an inserting portion being removably insertable into the elongated cavity of the female component. At least one of the male and female components is provided with at least one tapered surface, and the male and female components of the anchoring
(Continued)

system are shaped and sized with respect to one another so that a spacing tolerance between the male and female components decreases as the male component is inserted into the elongated cavity of the female component along the longitudinal axis thereof.

20 Claims, 24 Drawing Sheets

(51) Int. Cl.
*E04G 5/14* (2006.01)
*E04G 21/32* (2006.01)
*E04H 12/00* (2006.01)

(58) Field of Classification Search
USPC ..... 52/704, 298
See application file for complete search history.

(56) References Cited

U.S. PATENT DOCUMENTS 3,204,898 A * 9/1965 Manning ..... E04F 11/1812 248/516
3,420,013 A * 1/1969 Alvarado ..... E04F 11/1812 52/161
3,462,126 A * 8/1969 Rodolphe ..... C12N 1/38 256/65.12
3,612,287 A * 10/1971 Maltese ..... A47F 5/04 52/298
4,045,003 A * 8/1977 McCluskey ..... E04F 11/181 256/59
4,752,060 A * 6/1988 McCluskey ..... E04F 11/181 256/59
4,840,524 A * 6/1989 Bisping ..... F16B 13/141 411/82
7,437,857 B1 * 10/2008 Maguire ..... A45F 3/44 182/87
8,250,828 B2 * 8/2012 Zimmer ..... F16B 5/01 52/704
9,260,258 B1 * 2/2016 Leum ..... B65G 69/2888
2005/0076601 A1 * 4/2005 Meadowcroft ..... E04G 21/3276 52/633
2006/0278472 A1 * 12/2006 Kenton ..... E04H 17/1417 182/113
2007/0137135 A1 * 6/2007 Shymkowich ..... E04G 21/3223 52/698
2010/0281816 A1 * 11/2010 Vigneault ..... E04G 21/185 52/701
2010/0287875 A1 * 11/2010 Zimmer ..... F16B 13/0858 52/699
2011/0083397 A1 * 4/2011 Zimmer ..... F16B 13/0858 52/699
2011/0296788 A1 * 12/2011 Cove ..... B29C 66/112 52/704
2016/0145873 A1 * 5/2016 Green ..... E04F 11/1812 52/832
2016/0222612 A1 * 8/2016 Leum ..... B65G 69/2888

FOREIGN PATENT DOCUMENTS

CH 706475 A2 * 11/2013 ..... E04G 21/3223
CH 713595 A2 * 9/2018 ..... E04F 11/1853
DE 2924432 4/1980
DE 3920260 A1 * 1/1991 ..... E04F 11/1812
DE 4338968 A1 * 5/1995 ..... E01F 13/024
DE 19836092 2/2000
DE 102006041211 A1 * 3/2008 ..... F16B 2/04
DE 102017125020 A1 * 4/2019 ..... E04F 11/1812
EP 1666682 A1 * 6/2006 ..... E04H 12/2261
FR 2300867 A1 * 9/1976 ..... E04F 11/1812
FR 2300868 A1 * 9/1976 ..... E04F 11/181
FR 2788804 A1 * 7/2000 ..... E04G 7/28
FR 2819861 A1 * 7/2002 ..... E04F 11/1814
FR 2981962 A1 * 5/2013 ..... F24S 25/10
GB 1496761 A * 1/1978 ..... E04F 11/1812
GB 2027779 2/1980
WO WO-9002860 A1 * 3/1990 ..... E04G 5/04
WO WO-2009004149 A2 * 1/2009 ..... E04D 13/1407

OTHER PUBLICATIONS

International Search Report and Written Opinion for International Application No. PCT/CA2017/051579, dated Mar. 22, 2018, (7 pages).

* cited by examiner

ANCHORING SYSTEM FOR RAILING

CROSS-REFERENCE TO RELATED APPLICATIONS

This application is a National Stage Application of PCT/CA2017/051579, filed Dec. 21, 2017, which claims benefit of Canadian patent application No. 2,952,477 filed Dec. 21, 2016, U.S. Provisional Patent Application Ser. No. 62/492,611 filed May 1, 2017 and U.S. Provisional Patent Application Ser. No. 62/524,173 filed Jun. 23, 2017, and which applications are incorporated herein by reference. To the extent appropriate, a claim of priority is made to each of the above-disclosed applications.

FIELD OF THE INVENTION

The present invention relates to an anchoring system, hereinafter referred to also as an "auto-locking quick-release safety railing system". More particularly, in accordance with a preferred intended use, the present invention relates to an anchoring system, such as the ones used with railings, guiderails and the like, and also relates to a corresponding railing and/or guiderail, and preferably a plurality thereof, provided with such a system, as well as to a kit for assembling the same, and to corresponding methods of manufacturing, assembly and use associated thereto.

BACKGROUND OF THE INVENTION

Railing systems and the different accessories used therewith, whether anchoring components and/or other types of devices, are well known in the art.

For example, known to the Applicant(s) of the present case are the following documents: U.S. Pat. Nos. 2,780,440; 3,698,135; 3,712,014; 5,214,986; 5,289,745; 5,349,977; 5,501,125; 6,409,419 B1; 7,055,807 B2; 7,334,957 B2; 7,472,891 B2; 7,954,289 B2; 8,024,997 B2; 9,371,619 B2; JP 09-184331; and WO 2012/139149 A1.

Despite these various improvements over the years, there is always a need to continue innovating and finding better and/or different ways of anchoring railings, guiderails, etc., to a ground surface, for example, in a more efficient, more precise, more accurate, more reliable, more adjustable, more versatile, more adaptable, more stable, more secure, and/or more desirable manner.

Indeed, it would be particularly advantageous to provide an anchoring system capable of easily, quickly and securely anchoring a corresponding railing into place, into a corresponding base surface, or onto a given structure (ex. roofs, platforms, etc.), while enabling said corresponding railing to be easily and quickly released from the base surface or the given structure thanks to the design of the anchoring system.

Thus, it would be particularly useful to be able to provide an improved anchoring system which, by virtue of its design and components, would be able to overcome or at the very least minimize some of known drawbacks associated with conventional anchoring systems used for railings and the like, for example.

SUMMARY OF THE INVENTION

An object of the present invention is to provide an anchoring system which, by virtue of its design and components, is intended to satisfy the above-mentioned need, and which thus aims to offer an improvement over other related anchoring systems and/or methods known in the prior art.

In accordance with the present invention, the above object is achieved, as will be easily understood from the present description, with an anchoring system such as the one briefly described herein and/or such as the one(s) exemplified in the accompanying drawings.

According to one aspect of the present invention, there is provided an anchoring system for use with an erectable guiderail intended to be anchored with respect to a base surface, the anchoring system comprising:

- a female component being positioned and sized for lodging into a corresponding hole provided about the base surface and about which the guiderail is intended to be anchored, the female component defining an elongated cavity having a longitudinal axis; and
- a male component being operatively mountable onto a corresponding portion of the guiderail and being securable therewith, the male component having an insertion portion being removably insertable into the elongated cavity of the female component;
- wherein at least one of the male and female components is provided with at least one tapered surface, and wherein the male and female components of the anchoring system are shaped and sized with respect to one another so that a spacing tolerance between the male and female components decreases as the male component is inserted into the elongated cavity of the female component along the longitudinal axis thereof.

According to another aspect of the present invention, there is also provided at least one railing configured to be used with the above-mentioned anchoring system.

According to another aspect of the present invention, there is also provided a corresponding kit for assembling a corresponding railing structure including a plurality of the above-mentioned anchoring system(s) and/or railing(s).

According to another aspect of the present invention, there is also provided a method of manufacturing the above-mentioned anchoring system and/or railing(s), and/or corresponding component(s) and/or accessory(ies) thereof.

According to yet another aspect of the present invention, there is also provided a method of assembling the above-mentioned anchoring system and/or railing(s), and/or corresponding component(s) and/or accessory(ies) thereof.

According to yet another aspect of the present invention, there is also provided a method of using (ex. operating, etc.) the above-mentioned anchoring system and/or railing(s), and/or corresponding component(s) and/or accessory(ies) thereof.

According to yet another aspect of the present invention, there is also provided a method of securing/mounting the above-mentioned railing(s) onto a corresponding base surface via the above-mentioned anchoring system.

According to yet another aspect of the present invention, there is also provided a kit with components for assembling the above-mentioned anchoring system and/or railing(s).

According to yet another aspect of the present invention, there is also provided a set of components (ex. modular components, etc.) for interchanging with components of the above-mentioned kit.

According to yet another aspect of the present invention, there is also provided a method of assembling components of the above-mentioned kit and/or set.

According to yet another aspect of the present invention, there is also a method of managing (ex. organizing, storing, dispatching, etc.) components of the above-mentioned kit and/or set.

According to yet another aspect of the present invention, there is also provided a method of doing business with the above-mentioned anchoring system, railing(s), associated complementary accessory(ies), kit, set and/or method(s).

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
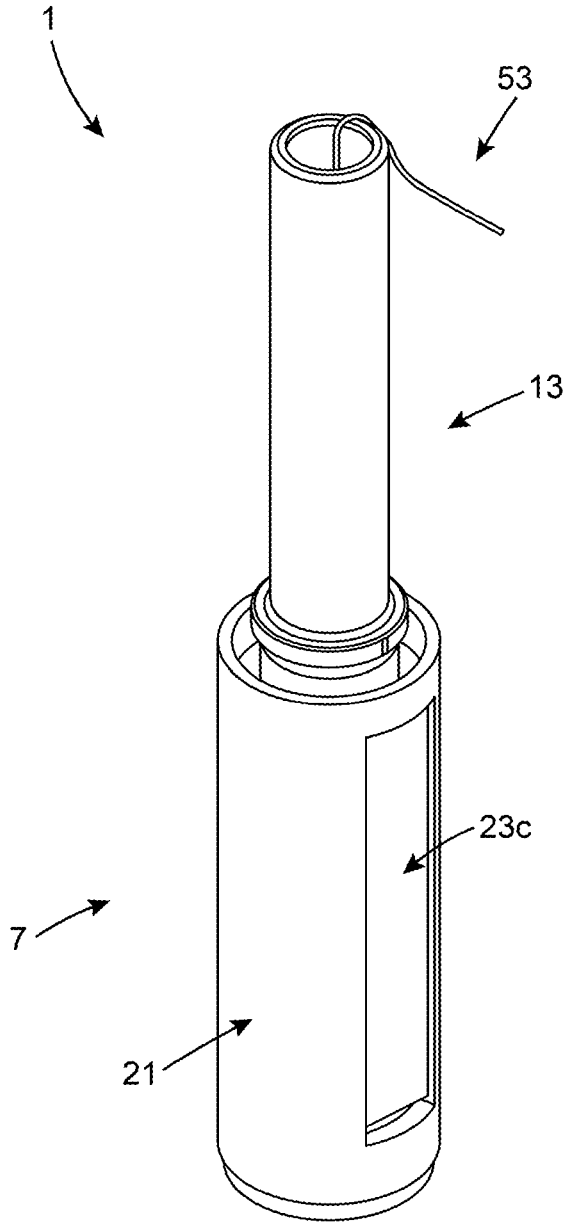
FIG. 1 is a perspective view of an anchoring system in an assembled configuration with a male component being shown inserted into a female component and being provided with a locking mechanism and corresponding linking component (ex. cable) according to a possible embodiment of the present invention.
Figure 2:
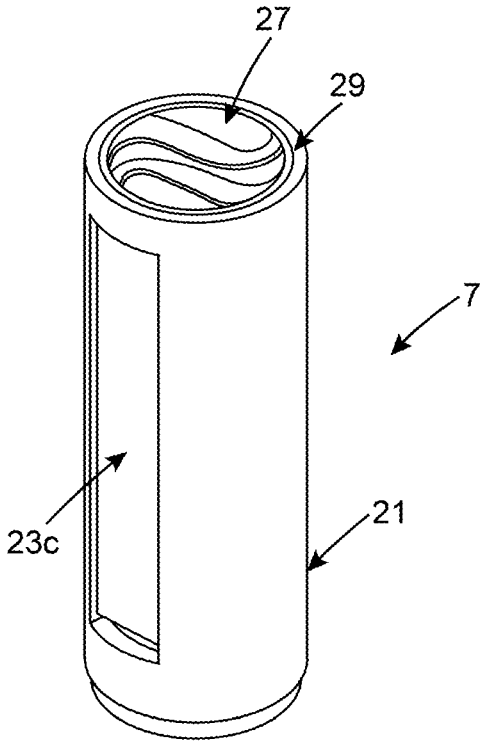
FIG. 2 is a top perspective view of the female component of FIG. 1, the female component being shown without the male component and corresponding linking component, and being now shown provided with a closing cap according to a possible embodiment of the present invention.
Figure 3:
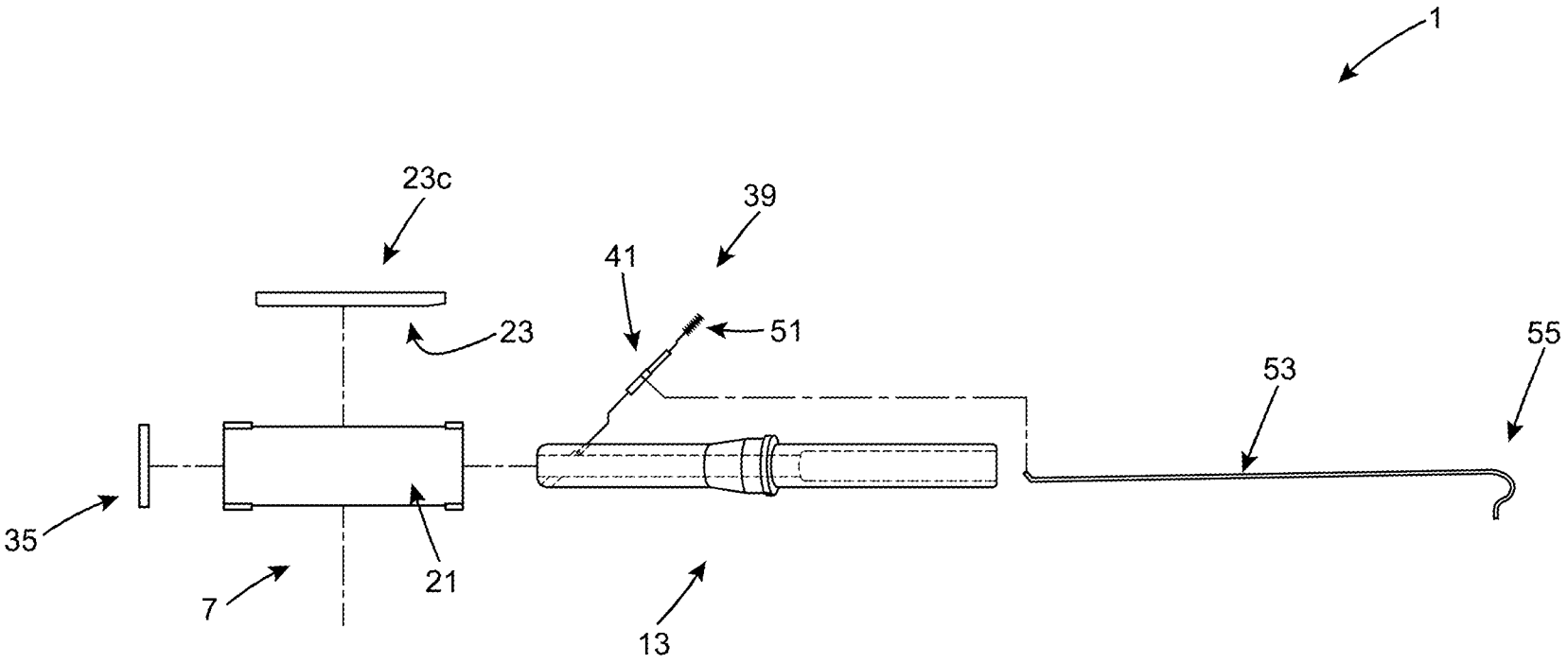
FIG. 3 is an exploded side view of components of an anchoring system according to a possible embodiment of the present invention.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions (expressed in inches, for example) shown in the figures are preferred, for exemplification purposes only.

Moreover, although the present invention was primarily designed for anchoring a railing and/or a guiderail onto a given base surface, whether a ground surface (ex. floor, etc.) and/or an elevated surface (ex. roof, platform, etc.), for example, it may be used with other objects and/or in other types of applications, as apparent to a person skilled in the art. For this reason, expressions such as "anchoring", "railing", "guiderail", "base", "ground", "elevated", "surface", "floor", "roof", etc., used herein should not be taken so as to limit the scope of the present invention and include all other kinds of objects and/or applications with which the present invention could be used and may be useful. Indeed, the present invention could be used to erect various other types of "barrier-like" devices (ex. fences, etc.), that is, upright structures intended to prevent certain people, animals, machinery, equipment, etc., from going beyond (ex. over, past, etc.) these structures, etc.

Moreover, in the context of the present invention, the expressions "anchor", "system", "tool", "device", "unit", "component", "assembly", "product", as well as any other equivalent expressions and/or compound words thereof, may be used interchangeably, as apparent to a person skilled in the art. This applies also for any other mutually equivalent expressions, such as, for example: a) "anchor", "secure", "fix", "immobilize", "jam", etc.; b) "guiderail", "railing", "fence", "barrier", "structure", "pole", "post", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that all elongated objects will have an implicit "longitudinal axis" or "centerline", such as the longitudinal axis of a tube, for instance, or the centerline of a bore, for example, and that expressions such as "connected" and "connectable", or "mounted" and "mountable", may be interchangeable, in that the present invention also relates to a kit with corresponding components for assembling a resulting fully-assembled and fully-operational anchoring system.

Moreover, components and/or features of the present anchoring system, and/or steps of the method(s) described herein, could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiments of the present invention as illustrated in the accompanying drawings comprise various components, and although the preferred embodiments of the anchoring system and corresponding parts as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the anchoring system and corresponding parts according to the present invention, as will be briefly explained herein and as can be easily inferred herefrom by a person skilled in the art, without departing from the scope of the present invention.

LIST OF NUMERICAL REFERENCES FOR SOME OF THE CORRESPONDING POSSIBLE COMPONENTS ILLUSTRATED IN THE ACCOMPANYING DRAWINGS

1. anchoring system
3. guiderail (or simply "railing", or ultimately, a single "post")
5. base surface
7. female component
9. elongated cavity (of female component)
11. longitudinal axis (of female component)
13. male component
13*a*. insertion tip (of the male component)
13*b*. rounded rim (of the male component)
13*c*. inner passage (of the male component)
15. insertion portion (of male component)
17. tapered surface
17*a*. upper inner tapered surface (provided on female component)
17*b*. bottom inner tapered surface (provided on female component)
17*c*. main inner tapered surface (provided on female component)
17*d*. wedging body tapered surface (provided on male component)
19. contact point
19*a*. upper contact point
19*b*. bottom contact point
21. casing (or "receptacle")
23. guiding surface (ex. guiding bar)
23*a*. top portion (of guiding bar)
23*b*. supporting portion (of guiding bar)
23*c*. side portion (of guiding bar)
25. lateral cutaway
27. top cap (or simply "closing cap")
29. inlet (of elongated cavity)
31. seal (of top cap)
33. recess (of top cap)
35. bottom cap (of casing)
37. orifice (of bottom cap)
39. locking mechanism
41. locking pin
41*a*. proximate portion (of locking pin)
41*b*. distal portion (of locking pin)
41*c*. bore (of locking pin)
43. shouldering part
45. spring-loaded mechanism
47. first orifice (for locking pin)
49. second orifice (for locking pin)
51. spring
53. linking component (ex. "cable", etc.)
55. key-lock mechanism
57. distal plug (of cable, for example)
59. jig assembly
61. support frame (of jig assembly)
63. guiding mechanism (of support frame)
65. support leg (of jig assembly)
67. channel (of guiding mechanism)
69. extension tool
71. pipe
73. levelling fastener
75. support rack Broadly described, the present invention, as exemplified in the accompanying drawings, relates to a quick-release locking hand-rail and corresponding anchoring system (1).

According to one possible embodiment, the anchoring system (1) is used with an erectable guiderail (3) intended to be anchored with respect to a base surface (5), and comprises a female component (7) and a male component (13). The female component (7) may be positioned and sized for lodging into a corresponding hole (and/or other suitable receiving structure) provided about the "base" surface (5) (for example, this surface could be a "ground" surface, such as a floor surface, or could even be an "elevated" surface (ex. roofs, platforms, other structures, etc.) and/or "open/flat" surface) and about which the guiderail (3) is intended to be anchored, the female component defining an elongated cavity (9) having a longitudinal axis (11). The male component (13) may be operatively mountable onto a corresponding portion of the guiderail (3) and being securable therewith (ex. the male component (13) may be a "separate" component from the guiderail (3), or may be an "integral" part thereof), the male component (13) having an insertion portion (15) being removably insertable into the elongated cavity (9) of the female component (7).

Indeed, as can be easily understood by a person skilled in the art, according to one possible embodiment, the male component (13) may take on the form of a "separate" component intended to be used as an "insert" in both, the female component (7), and with and/or into the corresponding guiderail (3) with which is intended to be used, but alternatively, the male component (13) according to the present system could also simply be a corresponding male component (13) protruding from a corresponding portion of the guiderail (3), and thus, the guiderail (3) could be designed and/or manufactured accordingly. Optionally, the present male component (13) can be simply an "insert" so as to advantageously be used with most conventional guiderails existing in the market, etc.

As can be easily understood from the accompanying drawings, and according to one aspect of the present system, at least one of the male and female components (13,7) is provided with at least one tapered surface (17), and the male and female components (13,7) of the anchoring system (1) are shaped and sized with respect to one another so that a spacing tolerance between the male and female components (13,7) decreases as the male component (13) is inserted into the elongated cavity (11) of the female component along the longitudinal axis (11) thereof. Namely, the more a user of the system "inserts" the male component (13) into the female component (7), the "tighter" the fit between them becomes. However, and as also exemplified in the accompanying drawings, and as described in greater detail hereinbelow, the male and female components (13,7) are also shaped and sized with respect to one another, so that removal of the male component (13) and corresponding guiderail (3) can be done "easily" and "quickly" with respect to the female component (7), upon a desired action of the user of the anchoring system (1), such as the release of a corresponding locking system, and/or the pulling of the male component (13) and/or corresponding guiderail (3) out from the female component (7).

As can also be easily understood from the accompanying drawings, the anchoring system (1) is operable between a first configuration where the spacing tolerance between the male and female components (13,7) is above zero, and a second configuration where the spacing tolerance zero becomes zero resulting from at least one contact point (19) occurring between the male and the female components (13,7).

Optionally, the male and female components (13, 7) are further shaped and sized with respect to one another so that the at least one contact point (19) (i.e. when the spacing tolerance becomes zero, etc.) occurs upon the male component 15 (13) reaches a given length into the elongated cavity (9) of the female component (7). This is exemplified in FIG. 4, for example.

According to a possible embodiment, the male and female components (13,7) are further shaped and sized with respect to one another so that the at least one contact point (19) includes both, at least one upper contact point (19*a*) and at least one lower contact point (19*b*), between the male and female components, occurring when the anchoring system (1) is operated in the second configuration.

Figure 4:
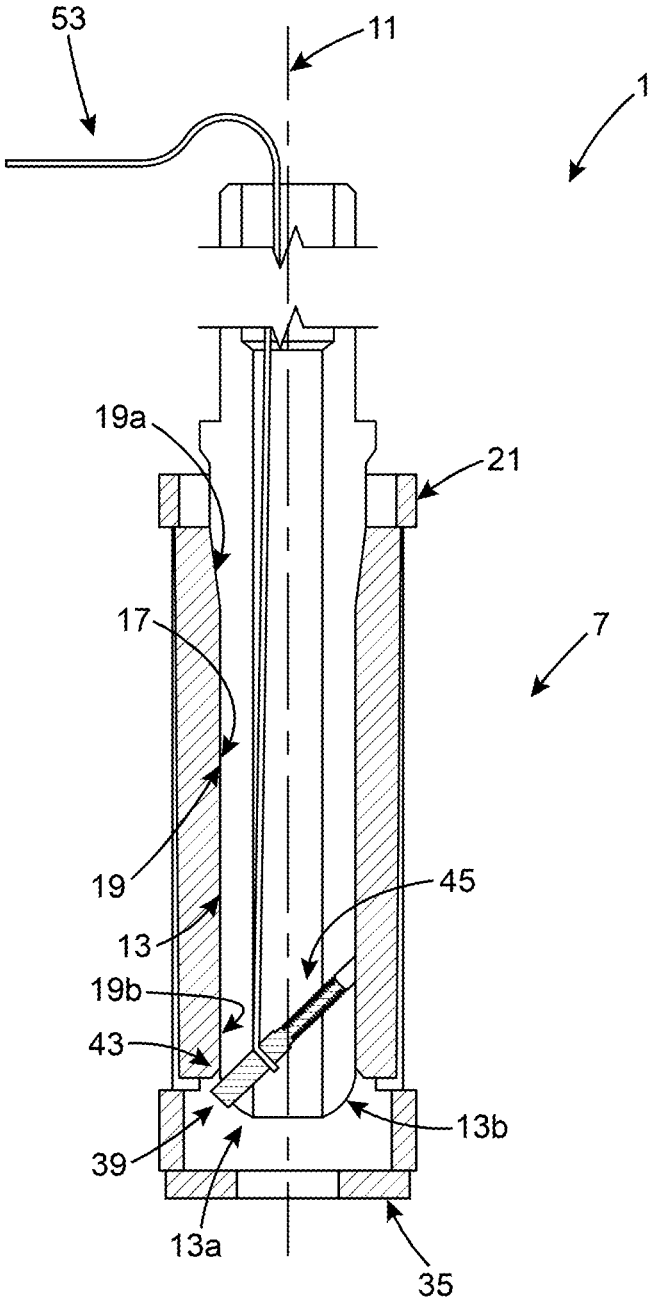
FIG. 4 is a cross-sectional view of an anchoring system in an assembled configuration with a male component being shown inserted into a female component and being provided with a locking mechanism and corresponding linking component (ex. cable) according to a possible embodiment of the present invention, the male component being shown partially.
Figure 5:
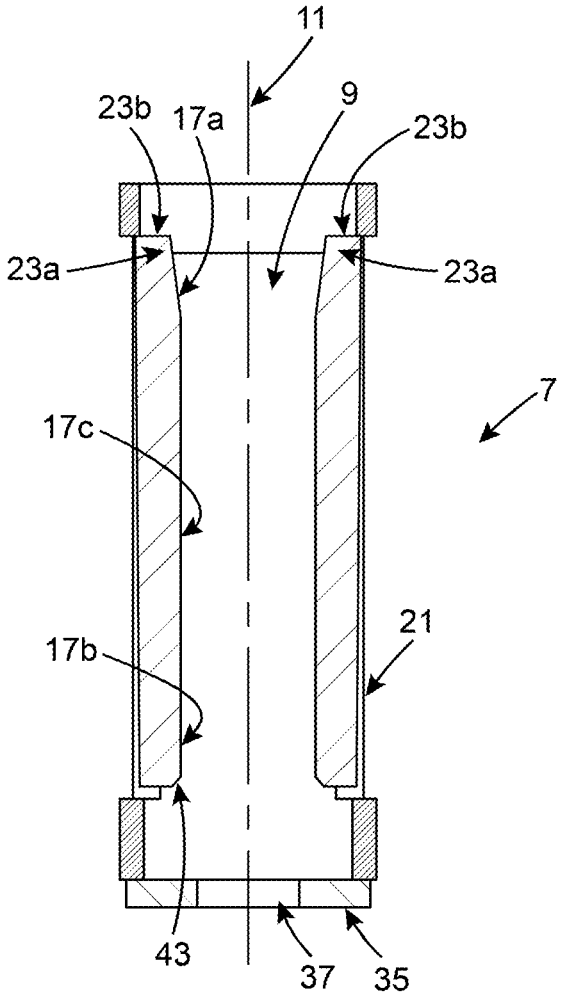
FIG. 5 is a cross-sectional view of a female component, including a casing provided with a pair of guiding bars, according to a possible embodiment of the present invention.
Figure 6:
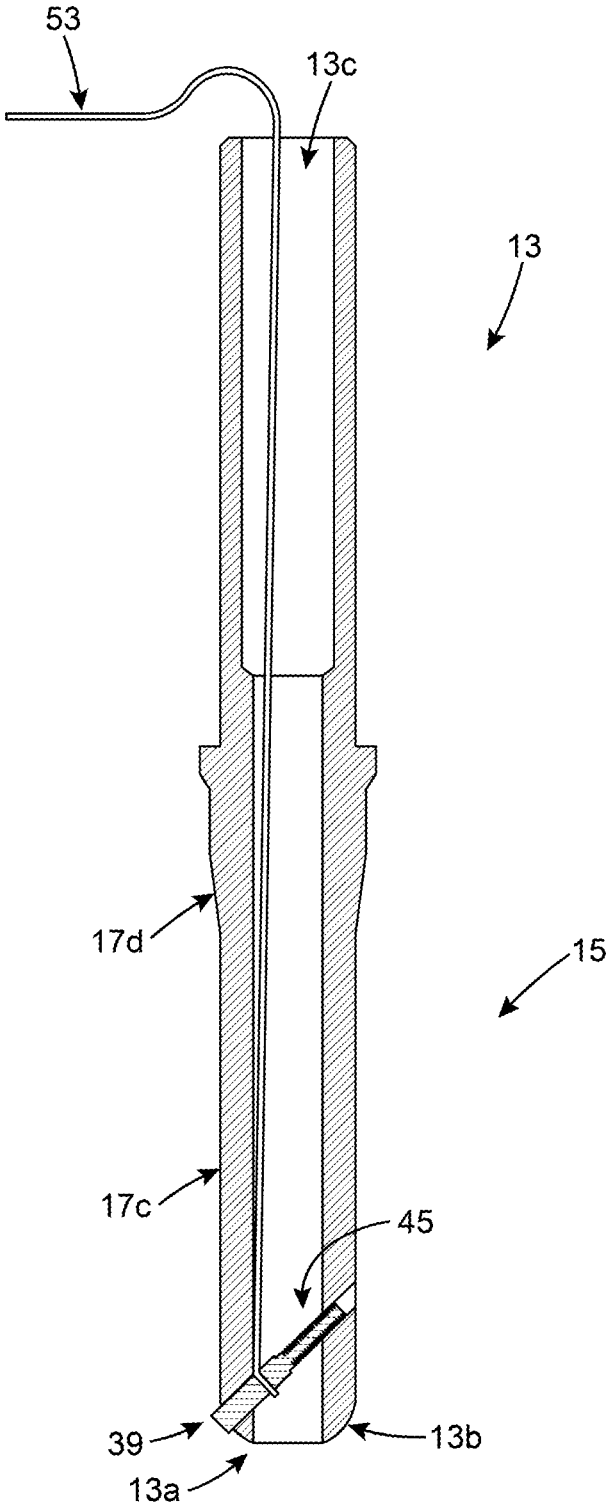
FIG. 6 is a cross-sectional view of a male component being provided with a locking mechanism and corresponding linking component connectable to a locking pin of the locking mechanism according to a possible embodiment of the present invention.
Figure 7:
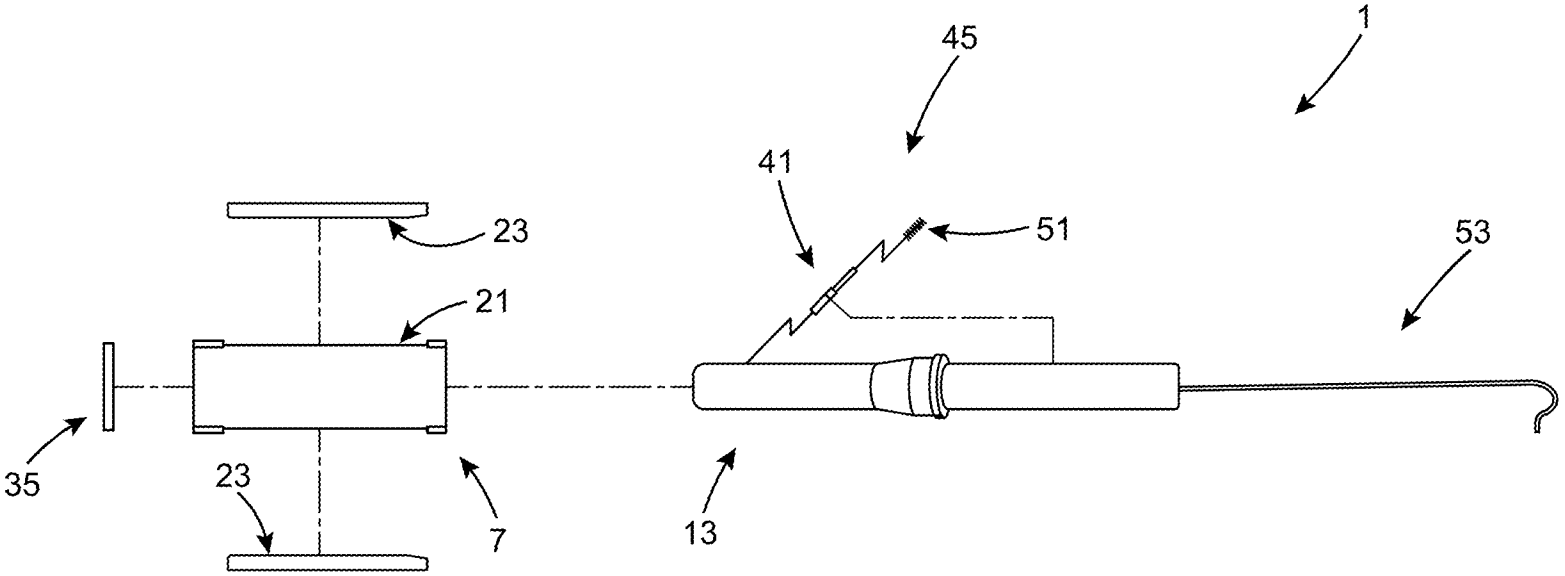
FIG. 7 is an exploded side view of components of an anchoring system according to a possible embodiment of the present invention.
Figure 8:
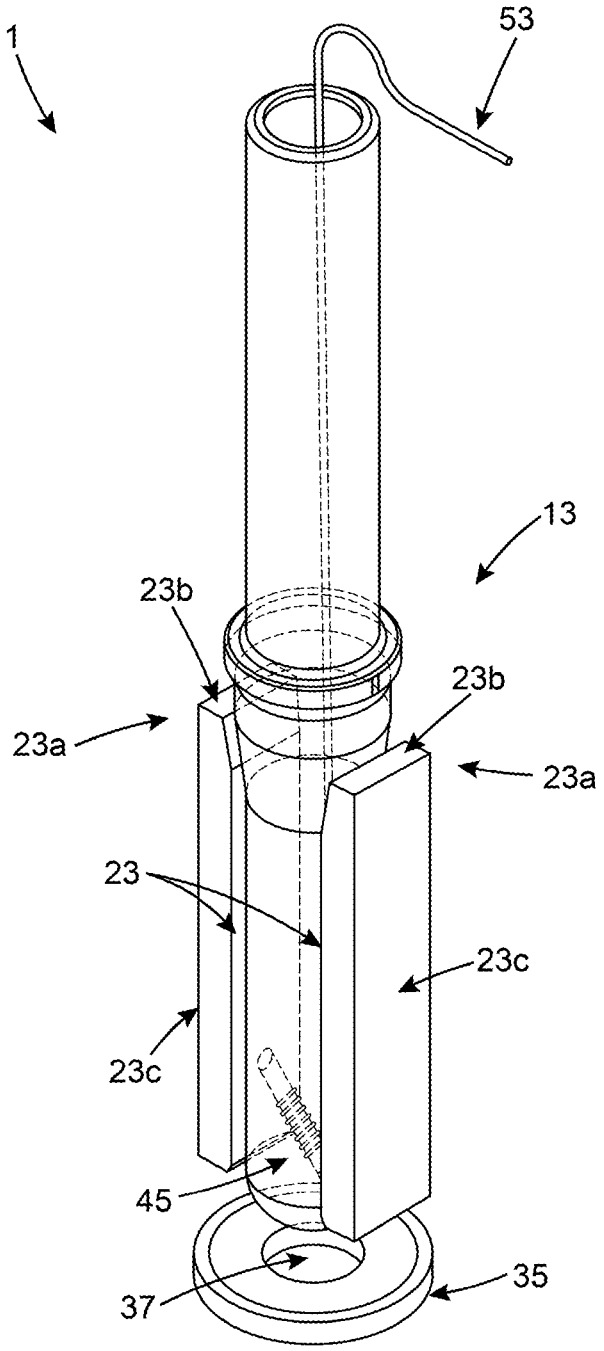
FIG. 8 is a perspective view of an anchoring system in an assembled configuration with a male component being shown inserted into a female component and being provided with a locking mechanism and corresponding linking component (ex. cable) according to another possible embodiment of the present invention.
Figure 9:
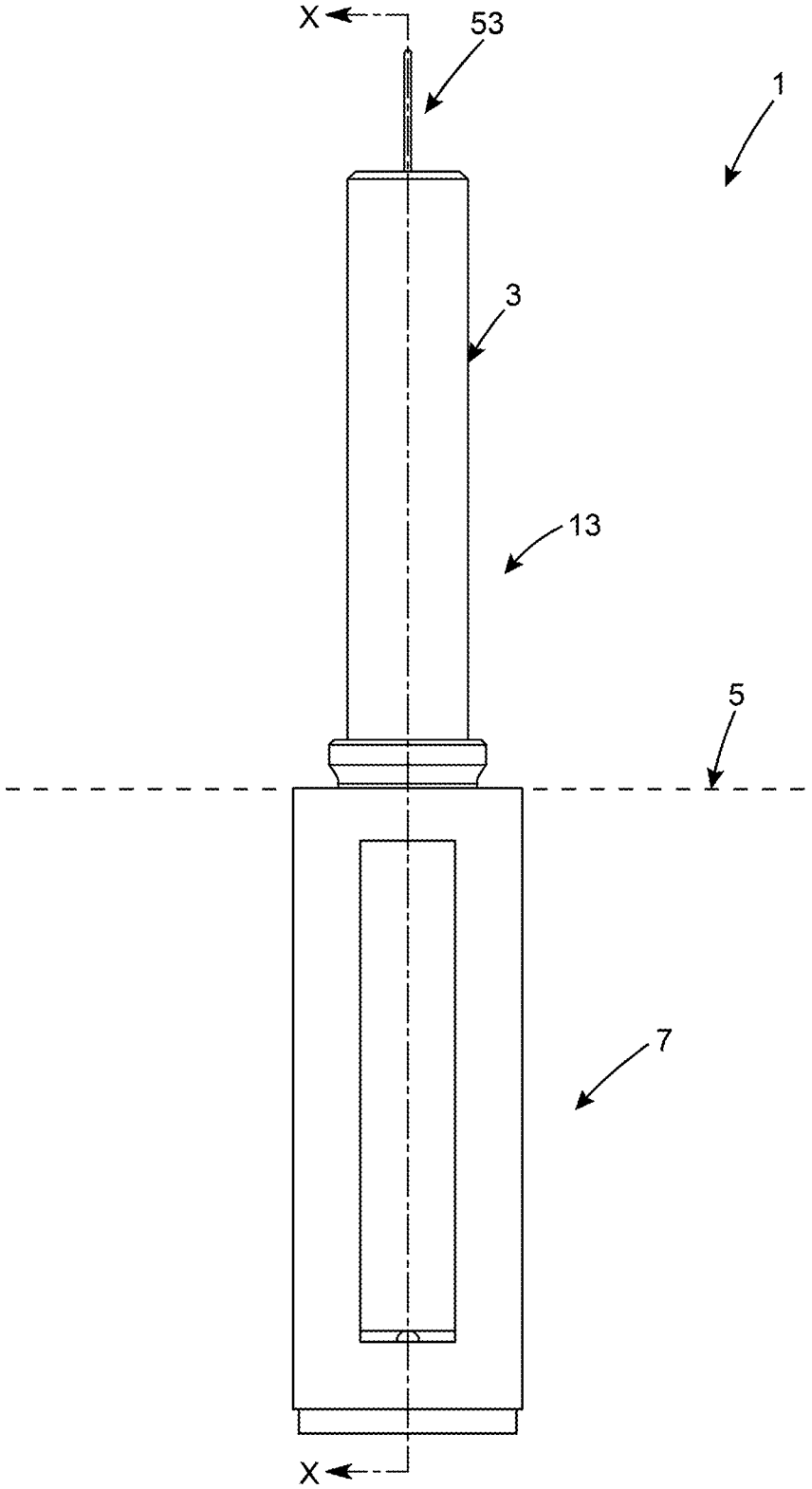
FIG. 9 is a side view of what is shown in FIG. 8.
Figure 10:
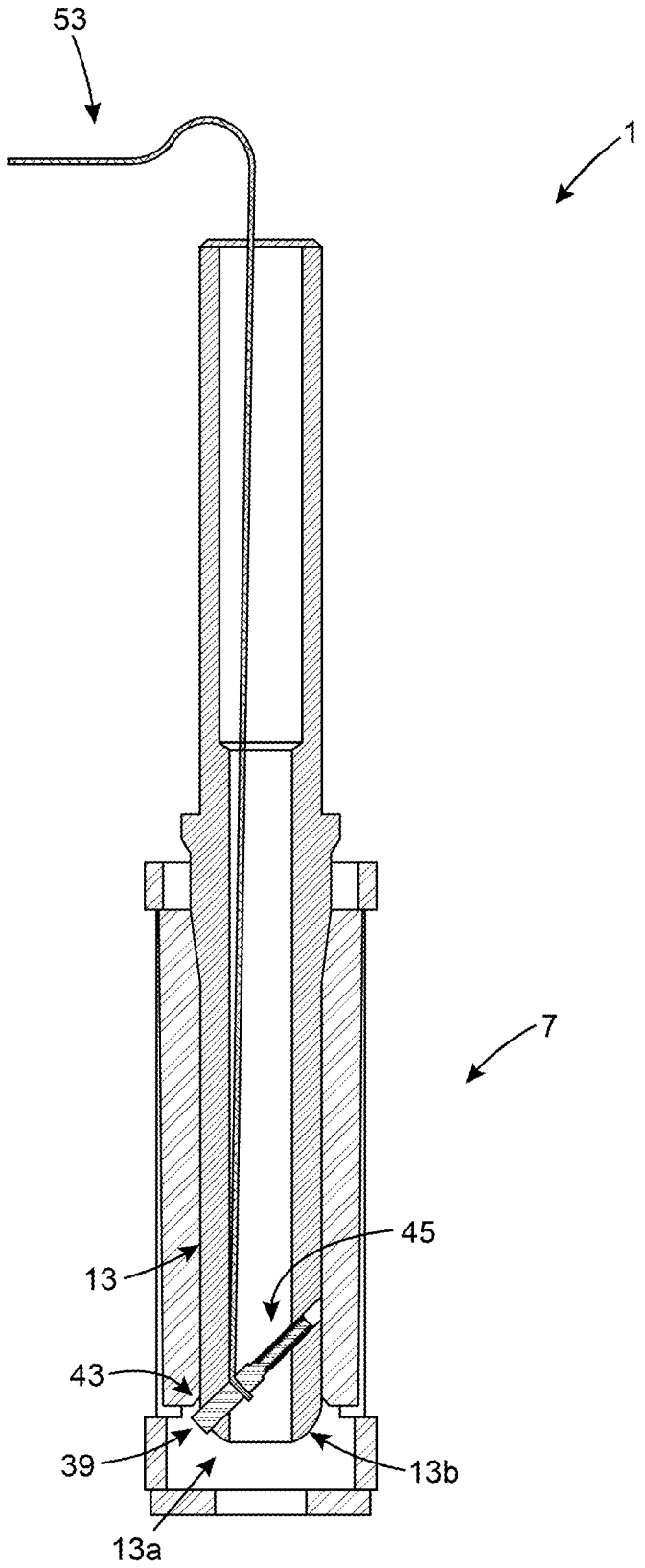
FIG. 10 is a cross-sectional view taken along line X-X of FIG. 9.
Figure 11:
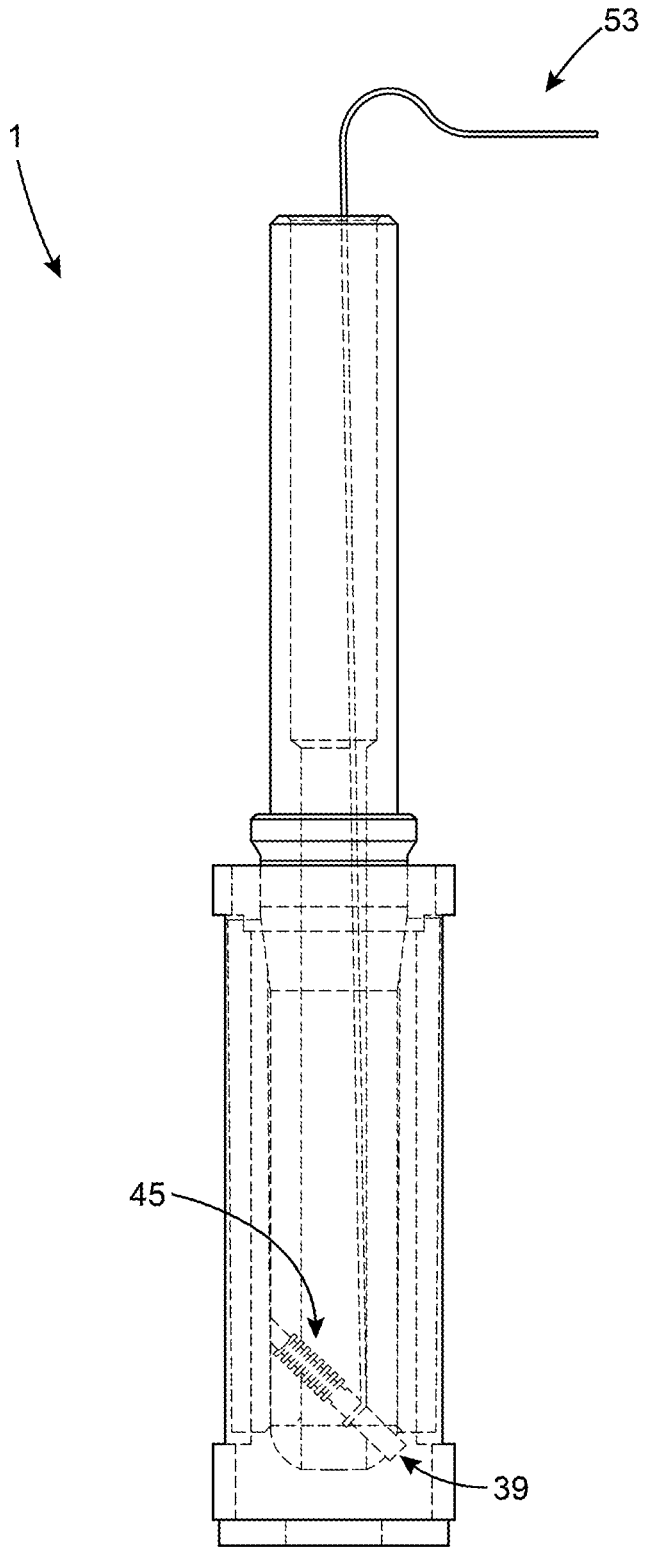
FIG. 11 is a transparent (or "see-through") view of what is shown in FIG. 9.

FIGS. 4, 5 and 6 exemplify how the at least one tapered surface (17) may include at least one main inner tapered surface (17*c*) provided about a main inner surface of the cavity (9) of the female component (7), said at least one main inner tapered surface (17*c*) providing a first contact point for the male and female components (13,7) of the anchoring system (1), and according to one possible embodiment of the system, the at least one main inner tapered surface (17*c*) is at an angle of about 1° with respect to the longitudinal axis (11) of the elongated cavity (9). Different possible angles and/or ranges thereof are intended according to the present system.

Similarly, the at least one tapered surface (17) includes at least one upper inner tapered surface (17*a*) provided about a top inner surface of the cavity (9) of the female component (13), said at least one upper inner tapered surface (17*a*) providing a second contact point for the male and female components (13,7) of the anchoring system (1), and according to one possible embodiment of the system, the at least one upper inner tapered surface (17*a*) is at an angle of about 5° with respect to the longitudinal axis (11) of the elongated cavity (9). Similarly, different possible angles and/or ranges thereof are also intended according to the present system.

As better shown in FIGS. 4-18, for example, the female component (7) may include a casing (21) defining the elongated cavity (9), and the at least one main inner tapered surface (17*c*) may be provided by at least one guiding bar (23) being mountable onto the casing (21). In such a case, the at least one upper inner tapered surface (17*a*) can be provided by the at least one guiding bar (23).

Optionally also, the casing (21) may include at least one lateral cutaway section (25), so that the at least one guiding bar (23) be mountable onto the casing (21) via the at least one lateral cutaway section (25) of the casing (21).

The at least one guiding bar (23) may be secured in place onto the casing (21) by means of welding, although other suitable means of affixing, connection and/or securing, are also intended according to the present system.

According to one particular embodiment, the at least one guiding bar (23) includes a pair of first and second guiding bars (23) being mountable respectively onto first and second opposite sides of the casing (21).

Optionally, the first and second guiding bars (23) are mountable respectively onto first and second lateral cutaway sections (25) of the casing (21), and the first and second guiding bars (23) may be securable respectively onto the first and second lateral cutaway sections (25) of the casing (21) by means of welding, although once again, other suitable affixing, connection and/or securing methods are contemplated according to the present system.

According to one possible embodiment, the first and second lateral cutaway sections (25) of the casing (21) are positioned opposite to one another on the casing (21), as exemplified in the accompanying drawings.

As also shown, the first and second lateral cutaway sections (25) of the casing (21) may include a geometrical profile being complementary to that of the first and second guiding bars (23), and according to one possible embodiment, the first and second guiding bars (23) include rectangular plates, and the first and second lateral cutaway sections (25) of the casing (21) include a corresponding complementary rectangular profile, with the first and second guiding bars (23) being substantially identical to one another, although the first and second guiding bars (23) may be designed so as to be different with respect to another, depending on the particular applications for which the anchoring system (1) is intended for, and the end results being desired, as apparent to a person skilled in the art.

According to several embodiments illustrated in the accompanying drawings, the main body of the casing (21) is made to be substantially cylindrical, and the first and second guiding bars (23) can be positioned, shaped and sized with respect to the casing (21) so that side portions (23*c*) of said first and second guiding bars (23) be present longitudinally inside the elongated cavity (9) of the female component (7).

Optionally, the first and second guiding bars (23) are further positioned, shaped and sized with respect to the casing (21) so that top portions (23*a*) of said first and second guiding bars (23) be used as first and second supporting portions (23*b*) for a corresponding top cap (27) (or "closing" cap (27)) of the anchoring system (1), as can be easily understood when referring to FIGS. 2, 5 and 12-18, for example.

Figure 13:
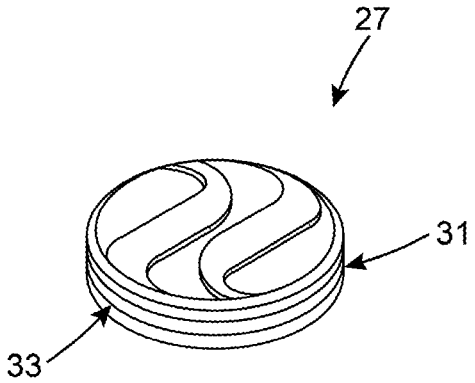
FIG. 13 is a perspective view of a closing cap intended to selectively close off the inlet of the female component of FIG. 12 according to a possible embodiment of the present invention.
Figure 14:
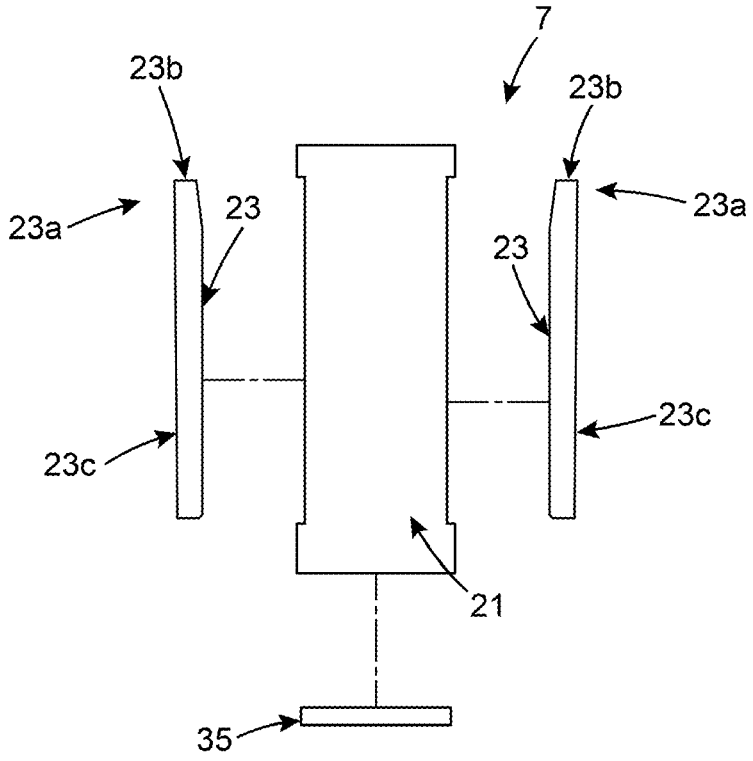
FIG. 14 is an exploded side view of components of what is shown in FIG. 13, to better illustrate sub-components of the female component according to a possible embodiment of the present invention, including casing, pair of guiding bars and corresponding bottom cap.
Figure 15:
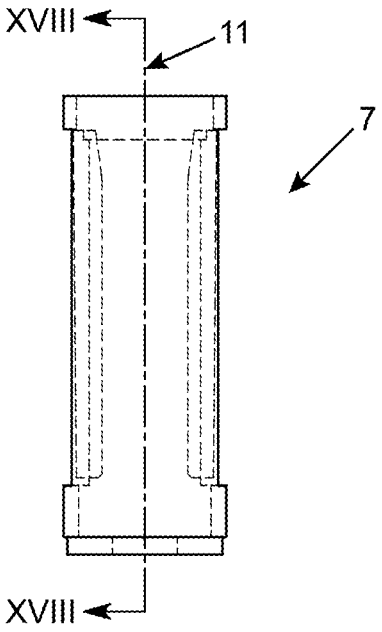
FIG. 15 is a front view of what is shown in FIG. 12.
Figure 16:
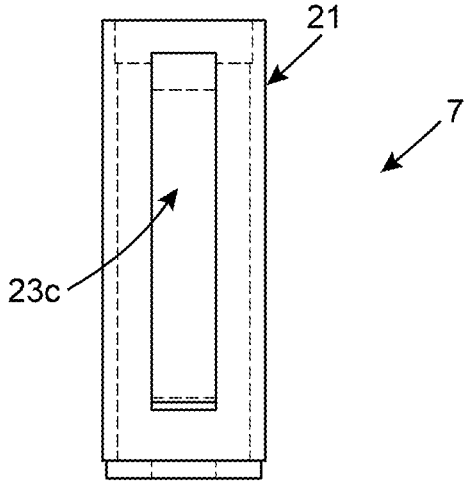
FIG. 16 is a side view of what is shown in FIG. 12.
Figure 17:
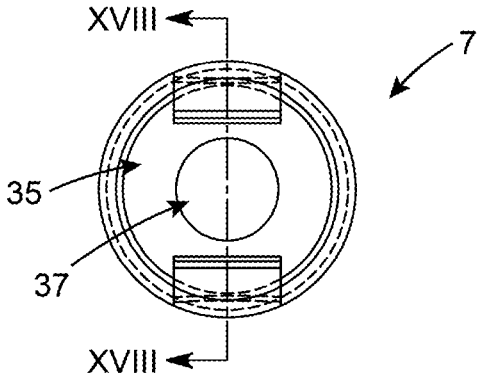
FIG. 17 is a top view of what is shown in FIG. 12.
Figure 18:
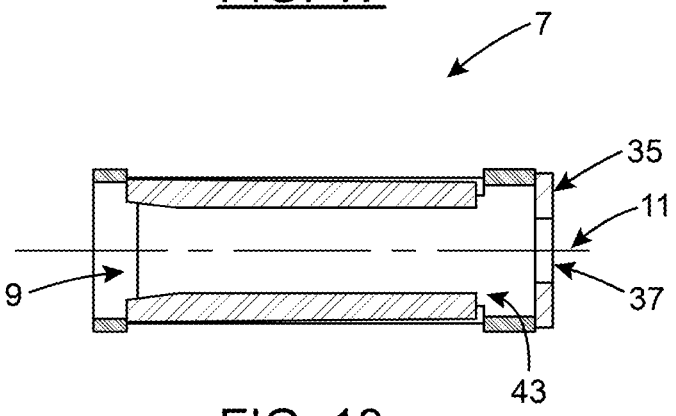
FIG. 18 is a cross-sectional view along line XVIII-XVIII of FIG. 15.
Figure 19:
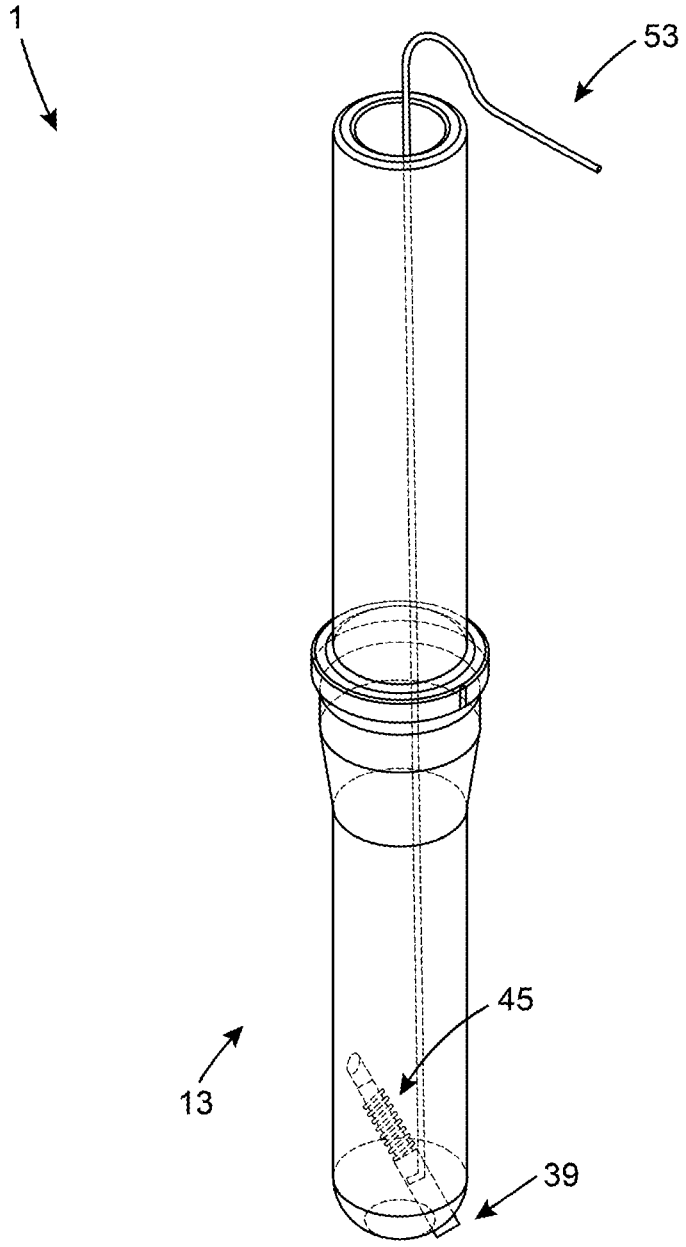
FIG. 19 is a perspective view of a male component being provided with a locking mechanism and corresponding linking component connected to a locking pin of the locking mechanism according to a possible embodiment of the present invention.
Figure 20:
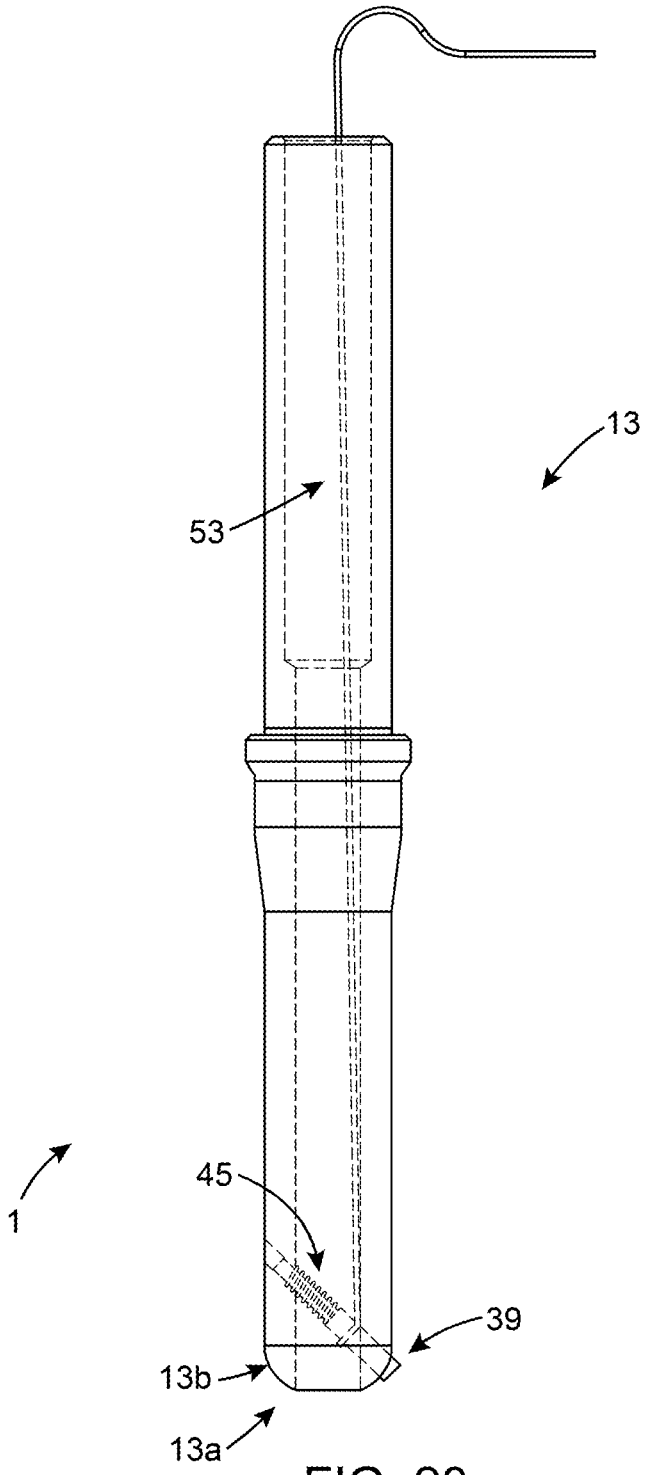
FIG. 20 is a side transparent (or "see-through") view of what is shown in FIG. 19.
Figure 21:
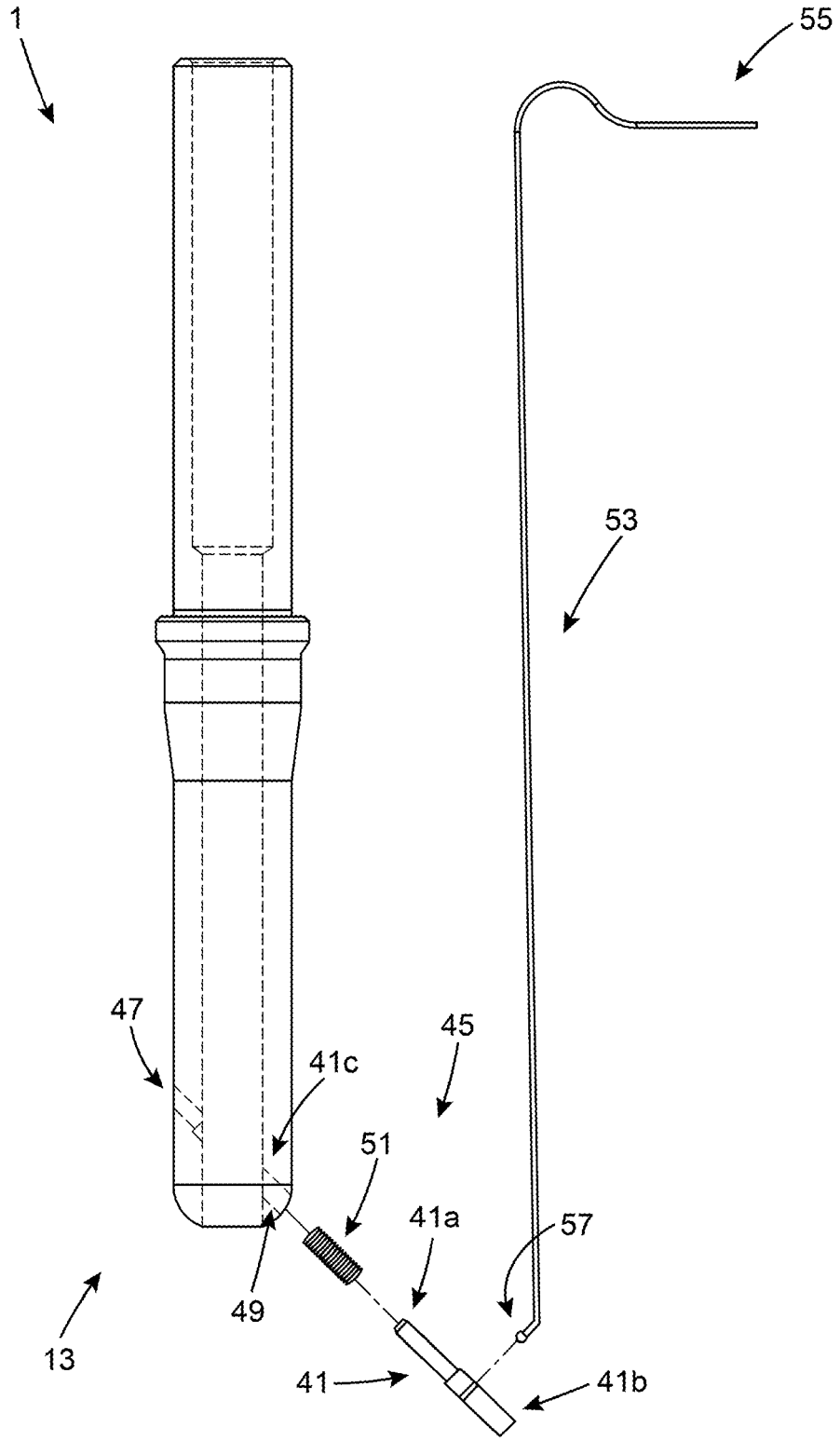
FIG. 21 is another side transparent (or "see-through") view of what is shown in FIG. 20, the locking mechanism and corresponding linking component being shown in an exploded relationship with respect to the male component to better illustrate possible components and features of the locking mechanism according to this particular embodiment.
Figure 22:
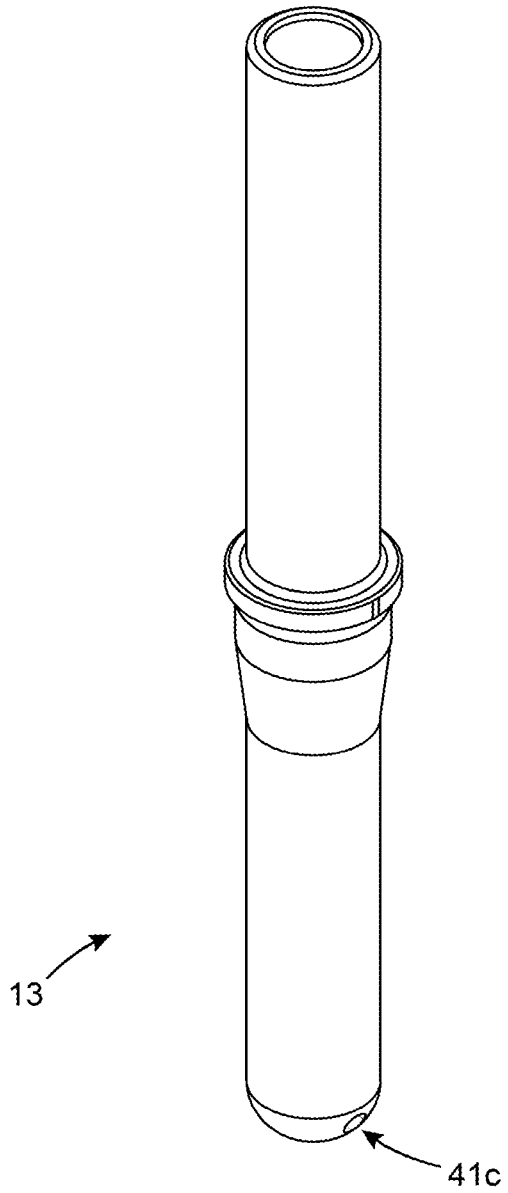
FIG. 22 is a perspective view of another male component according to a possible embodiment of the present invention.
Figure 23:
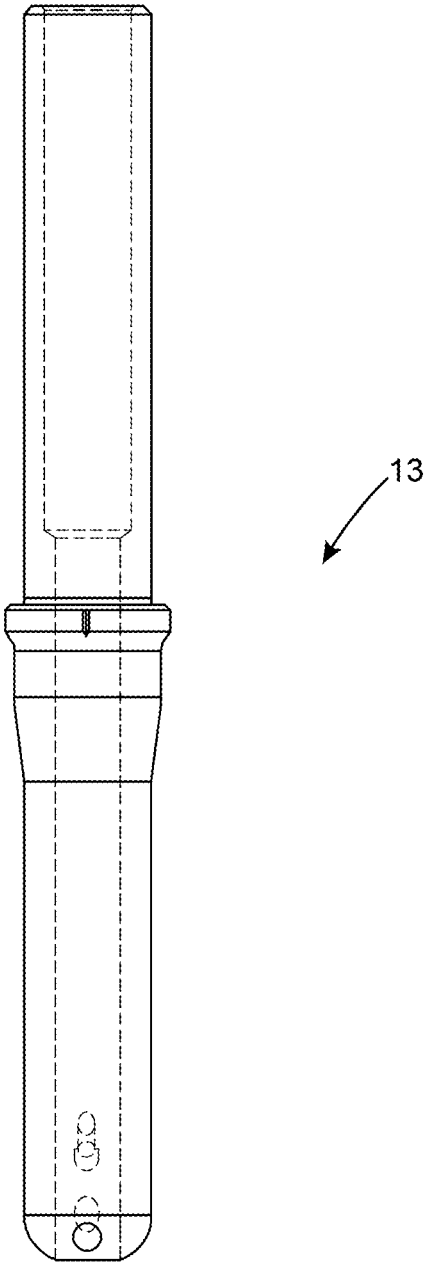
FIG. 23 is a front view of what is shown in FIG. 22.
Figure 24:
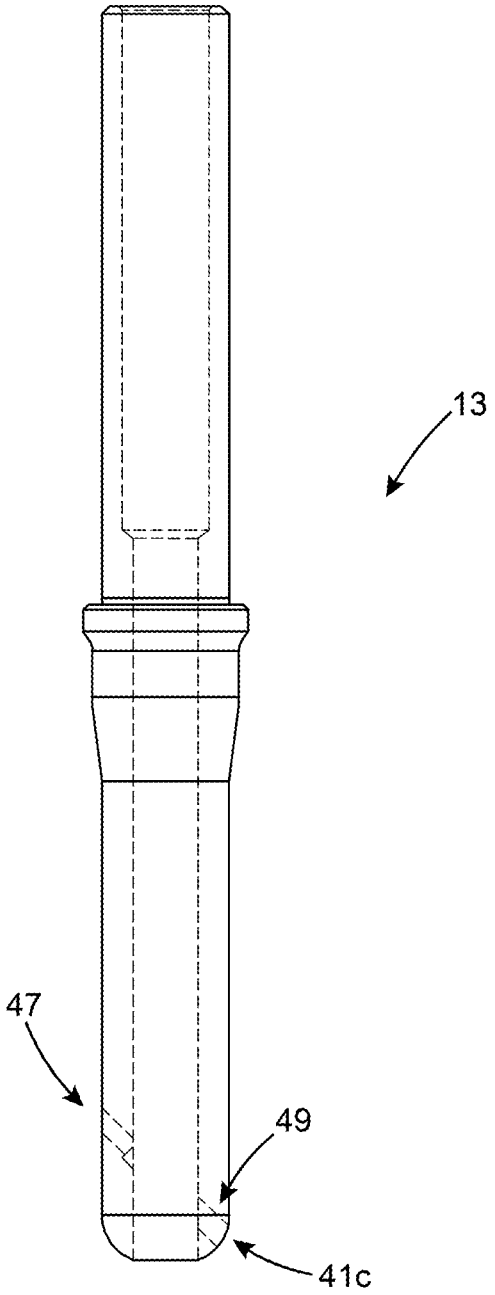
FIG. 24 is a side view of what is shown in FIG. 22.
Figure 25:
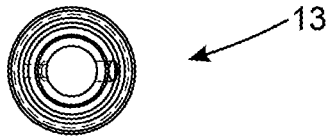
FIG. 25 is a top view of what is shown in FIG. 22.
Figure 26:
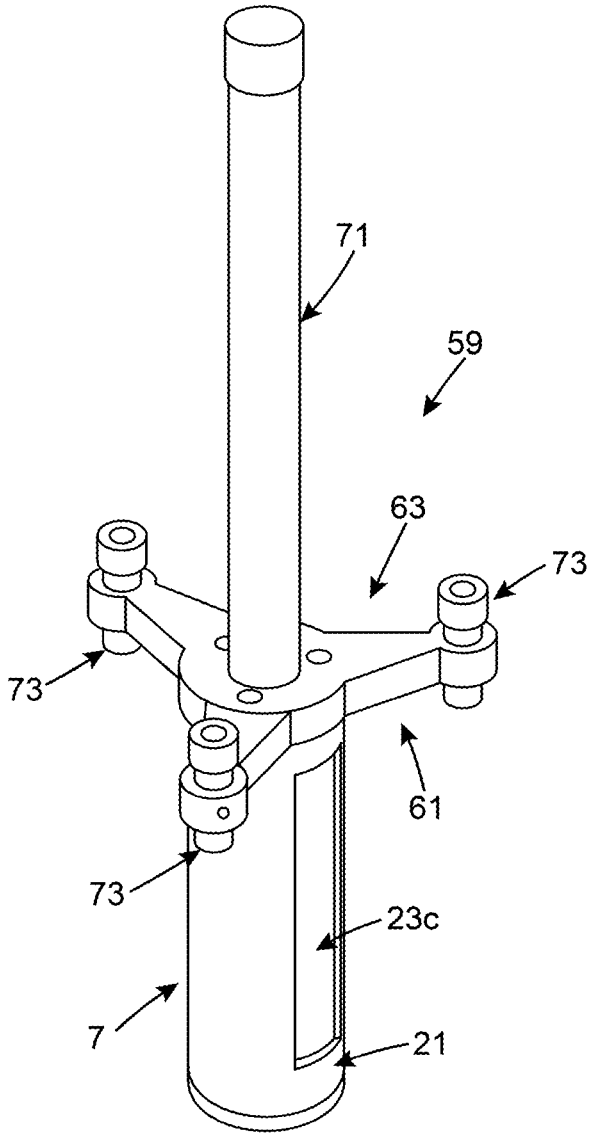
FIG. 26 is a perspective view of a jig assembly being provided with an extension tool cooperating with a female component intended to be inserted and to be anchored into a corresponding hole according to a possible embodiment of the present invention.
Figure 27:
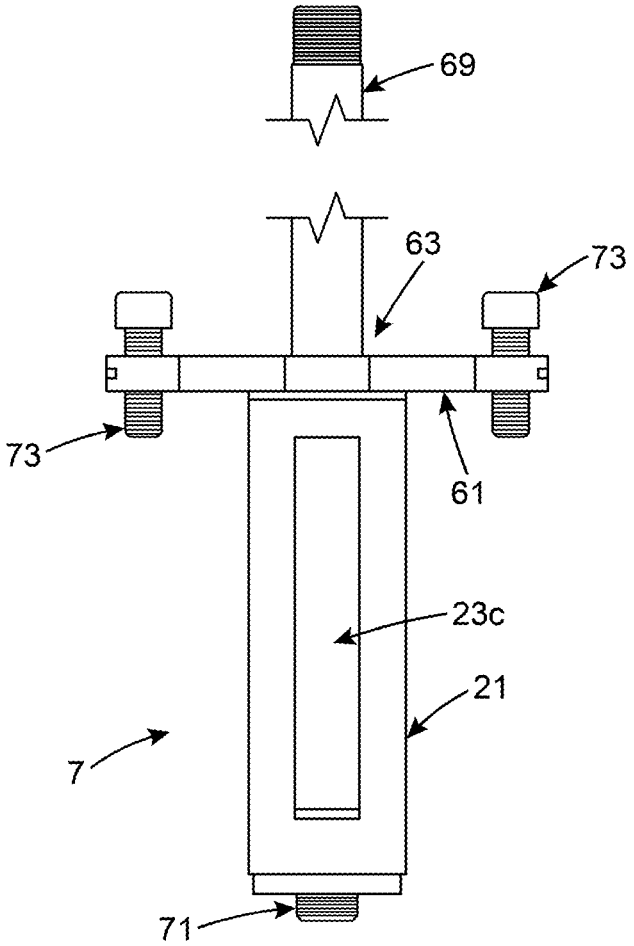
FIG. 27 is a front view of what is shown in FIG. 26.
Figure 28:
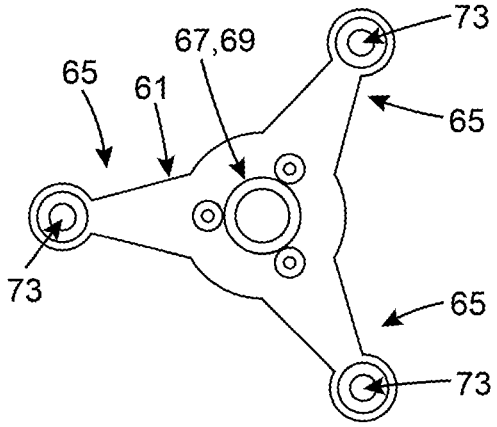
FIG. 28 is a top view of what is shown in FIG. 26.
Figure 29:
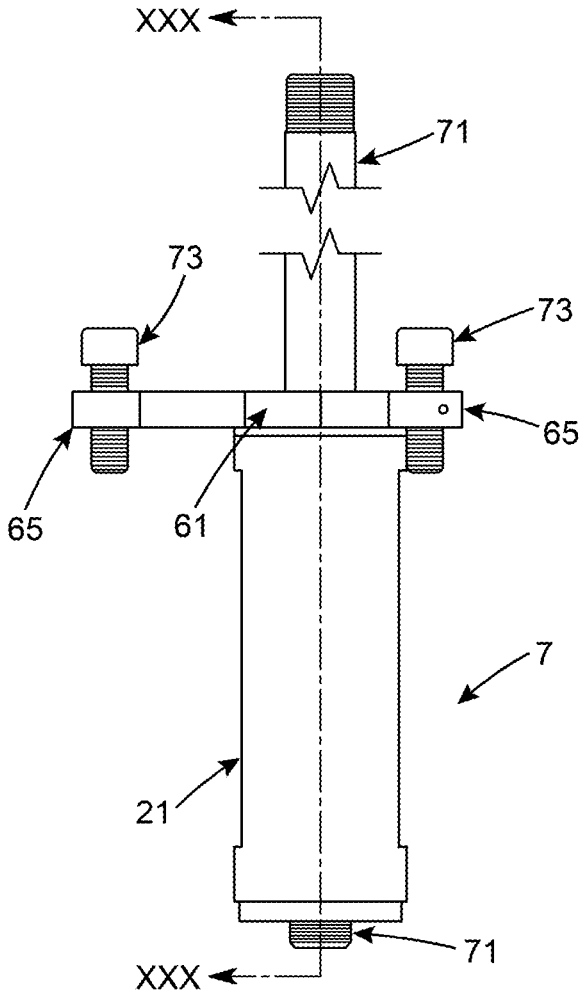
FIG. 29 is a side view of what is shown in FIG. 26.
Figure 30:
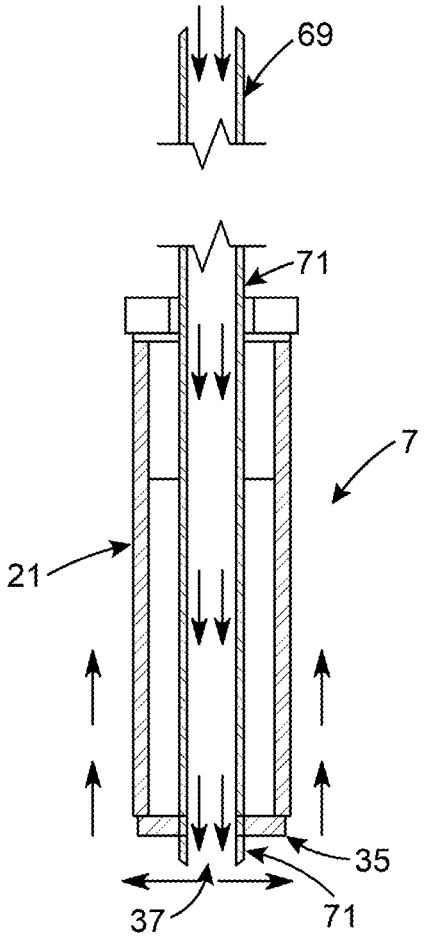
FIG. 30 is a cross-sectional view take along line XXX-XXX of FIG. 29.

Indeed, as exemplified in these drawings also, and according to a particular embodiment, the anchoring system (1) includes a closing cap (27) being further positioned, shaped and sized so as to selectively and sealingly cover an inlet (29) of the elongated cavity (9), the closing cap (27) being further provided with a corresponding seal (31), which may include an O-ring being mountable about a peripheral recess (33) defined about the closing cap (27), for example, as better shown in FIG. 13.

Figure 12:
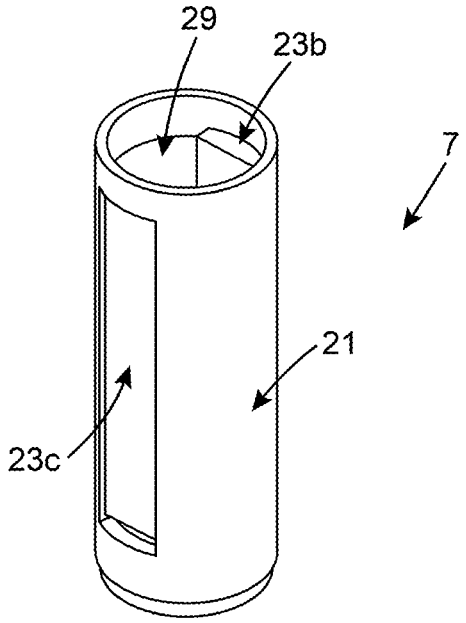
FIG. 12 is a perspective view of a female component, including a casing provided with a pair of guiding bars, according to a possible embodiment of the system.

Advantageously also, the closing cap (27) may be further shaped and sized so as to flip over "open" with respect to the inlet (29) of the elongated cavity (9) upon pushing on a side of the closing cap (27) deprived of an underlying supporting portion (23*b*), as can be easily understood when referring to FIGS. 12 and 13.

As better shown in FIGS. 1-14, for instance, the female component (7) may include a bottom cap (35) being securable in place onto a bottom portion of the casing (21) by means of welding, for example.

The bottom cap (35) may include an orifice (37) configured for a receiving a corresponding nozzle of a device intended to insert setting material into the hole of the base surface (5) where the female component (7) or "assembly" is lodged, via the orifice (37) of the bottom cap (35) of the casing (21), so as to securely fix the female component (7) in place inside the hole with the setting material to be cured, etc.

Optionally also, the orifice (37) of the bottom cap (35) may be provided with threading for threadedly engaging the corresponding nozzle of the device (and/or corresponding extension tool) intended to insert setting material into the hole of the base surface (5) via the orifice (37) of the bottom cap (35) of the casing (21).

As can be easily understood when referring to the other accompanying drawings also, the anchoring system (1) may include a locking mechanism (39) for locking the male component (13) in place with respect to the female component (7).

The locking mechanism (39) may include a locking pin (41) provided about a portion of the male component (13), and being operable between "locked" and "unlocked" configurations, where, in the "locked" configuration, the locking pin (41) of the male component (13) is in abutment with a corresponding shouldering part (43) of the female component (7), thereby preventing the male component (13) from being removed from the female component (7), and where, in the "unlocked" configuration, the locking pin (41) of the male component (13) is drawn away from the shouldering part (43) of the female component (7), thereby allowing the male component (13) to be removed from the female component (7).

The locking pin (41) may be configured to be urged into the locked configuration, by default, via a spring-loaded mechanism (45), for example.

According to one particular embodiment, the locking pin (41) is mountable onto first and second orifices (47,49) of the male component (13). The first and second orifices (47,49) of the male component (13) can be provided on opposite sides of the male component (13), and according to one alternative, the first orifice (47) of the male component (13) is smaller than the second orifice (49) of the male component (13), and a proximate portion (41*a*) of the locking pin (41) is insertable into the first orifice (47) of the male component (13) having a cross-sectional profile being smaller than a corresponding cross-sectional profile of a distal portion (41*b*) of the locking pin (41) being insertable into the second orifice (49) of the male component (13).

The locking mechanism (39) may also include a spring (51) extending about the proximate portion (41*a*) of the locking pin (41), the spring having a first end operatively pushing onto an inner wall of the male component (13) and a second end operatively pushing against a portion of the distal portion (41*b*) of the locking pin (41), in order to urge said locking pin (41) into the locked configuration via the spring (51).

According to another possible embodiment, the locking pin (41) is mountable onto the male component (13) in a slanted and/or angular manner.

Optionally also, the proximate portion (41*a*) of the locking pin (41) is cylindrical, the distal portion (41*b*) of the locking pin (41) is cylindrical, and the spring (51) is coaxially mounted about the proximate portion (41*a*) of the locking pin (41).

The locking mechanism (39) may also include an unlocking assembly being operatively connectable to the locking pin (41) for enabling a user of the anchoring system (1) to selectively operate the locking mechanism (39) into the unlocked configuration.

For example, the unlocking assembly may include a linking component (53) having a first end operatively connectable to the locking pin (41), and configured such that an activation of the linking component (53) overrides a spring-loaded effect of the locking mechanism (39) and draws the locking pin into the unlocked configuration.

The linking component (53) may also have a second end being operatively connectable to a corresponding key-lock mechanism (55), the key-lock mechanism (55) being selected from the group consisting of a mechanical key-lock mechanism (55), a biometric key-lock mechanism (55) and an electromagnetic key-lock mechanism (55).

As exemplified in the accompanying drawings, and according to another possible embodiment, the male component (13) may be a hollow male component, and may include an inner passage (13*c*) extending between opposite extremities of the male component (13), and with the linking component (53) extending through the inner passage (13*c*) of the male component (13).

The male component (13) may include an insertion tip (13*a*) provided with a rounded rim (13*b*), and the locking pin (41) may be designed to extend out from the rounded rim (13*b*) of the insertion tip (13*a*) of the male component (13), as better shown in FIGS. 4, 10 and 19-25.

According to a possible embodiment, the linking component (53) may simply include a cable having a first end operatively mountable onto the locking pin (41), and configured such that a pulling action of the cable overrides a spring-loaded effect of the locking mechanism (39) and draws the locking pin (41) into the unlocked configuration.

The first end of the cable could be insertable into a corresponding transversal bore (41*c*) of the locking pin (41), and provided with a corresponding distal plug (57), for example, as also exemplified in the accompanying drawings.

According to another aspect of the present system, there is also provided an erected railing structure for fencing off a given area about a base surface (5), and the railing structure can comprise at least one guiderail (3), the at least one guiderail (3) being capable of erected and anchored with respect to the base surface (5) with at least one anchoring system (1) such as the one described and/or illustrated in the present specification.

According to yet another aspect of the present system, there is also a kit for assembling and erecting a railing structure to be used for fencing off a given area about a base surface (5), and the kit can comprise: a) at least one anchoring system (1) such as the one described and/or illustrated in the present specification; and b) a plurality of corresponding guiderails (3), at least one of said plurality of corresponding guiderails (3) being anchored with respect to the base surface (5) with said at least one at least one anchoring system (1).

As exemplified in FIGS. 26-30, for instance, the kit may further include a jig assembly (59) (or "levelling assembly") for assisting in installing female components (7) of the anchoring system (1) into corresponding holes of the base surface (5) along which the railing structure is to be erected and anchored.

The jig assembly (59) may come in various shapes and forms, but according to a possible embodiment, the jig assembly (59) includes a support frame (61) for operatively resting onto the base surface (5) adjacent to a corresponding operative hole where a corresponding operative female component (7) of each anchoring system (1) is intended to be inserted and anchored, the support frame (61) being provided with a guiding mechanism (63) for guiding an insertion of the corresponding operative female component (7) into the corresponding operative hole, the support frame (61) of the jig assembly (59) having at least one support leg (65) with an adjustable component for tilting and levelling the support frame (61) of the jig assembly (59), as well as in turn the associated corresponding operative female component (7) intended to be inserted and anchored into the corresponding operative hole, with respect to said corresponding operative hole.

As can be easily understood when referring to FIGS. 26-30, the guiding mechanism (63) of the support frame (61) of the jig assembly (59) may include a channel (67) positioned, shaped and sized for receiving therethrough a corresponding extension tool (69) configured for cooperating with the corresponding operative female component (7) intended to be inserted and anchored into the corresponding operative hole.

The channel (67) can be disposed substantially centrally with respect to the support frame (61) of the jig assembly (59), for example, and the extension tool (69) may include a hollow pipe (71) having an extremity being threadedly engageable with the orifice (37) of the bottom cap (35) of the corresponding operative female component (7) intended to be inserted and anchored into the corresponding operative hole.

Advantageously, the hollow pipe (71) is further configured for allowing setting material to pass therethrough in order to fill the corresponding operative hole with setting material once the operative female component (7) is properly positioned into the corresponding operative hole where it is meant to be inserted and anchored.

According to one possible embodiment, the at least one support leg (65) of the support frame (61) of the jig assembly (59) includes a levelling fastener (73) being threadedly engaged and displaceable with respect to an extremity of said at least one support leg (65) in order to induce a corresponding corrective tilt of the support frame (61) of the jig assembly (59) via a positional adjustment of the levelling fastener (73) (ex. screw, bolt, etc.). Each levelling fastener (73) may be provided with a corresponding head/socket and/or knob in order to facilitate a rotation and corresponding positional adjustment of the levelling fastener (73) by a user of the present system.

Optionally, the at least one support leg (65) of the support frame (61) includes three corresponding support legs (65), and each of the three corresponding support legs (65) is provided with a corresponding levelling fastener (73) intended to provide an overall corresponding corrective tilt of the support frame (61) of the jig assembly (59) via a positional adjustment of each levelling fastener (73). Further optionally, the three corresponding support legs (65) can be disposed equidistantly with respect to one another, and about a common center point of the support frame (61) of the jig assembly (59).

The present kit may also include a support rack (75) for supporting the plurality of corresponding guiderails (3) prior to being anchored onto the base surface (5).

As may now better be appreciated, the present invention is a substantial improvement over the prior art in that, by virtue of its design and components, as explained hereinabove, the present anchoring system enables a user, to carry out anchoring of post(s), railing(s) and/or the like, for example, in a more efficient, more precise, more accurate, more reliable, more adjustable, more versatile, more adaptable, more stable, more secure, and/or more desirable manner, compared to what is possible with respect to other known conventional anchoring systems and/or methods.

Indeed, and as also previously explained, the present system is particularly advantageous in that, due to its components and features, it enables namely to offer a refined and accurately fitting tapered system, which enables the railing to be installed from a large angle, allowing easy entry into its lower socket for fast installation.

Indeed, an important feature of the present anchoring system resides in the tapered fitting which allows the railing system to accept large lateral tolerances. Among various advantages, this permits namely fabrication errors in the railing verticals of up to ¼ inch (approximately), and installation errors of the floor inserts of also ¼ inch (approximately), for a total allowance of about ½ inch (approximately also).

The present system is also very advantageous in that it is configured to have at least one of the male and female components being provided with at least one tapered surface, and the male and female components of the anchoring system being shaped and sized with respect to one another so that a spacing tolerance between the male and female components decreases as the male component is inserted into the elongated cavity of the female component along the longitudinal axis thereof, thereby creating a zero tolerance fit when the male component is "fully" inserted into the female component.

Another important feature of the present anchoring system resides in the locking system. This locking system is preferably spring-actuated and once the railing is installed, it automatically locks in place. The railing cannot be removed unless a release-lever is actuated, retracting thus the locking pin, which then allows the railing to be removed.

Another important feature of the present anchoring system resides in the closing caps being fitted with O-rings that fit into the floor inserts, thus capping and sealing the openings for safety. This innovative feature allows for floor washing and clean up without debris dropping down into the cavities.

Other possible aspect(s), embodiment(s), variant(s) and/or resulting advantage(s) of the present system are briefly described below: a) the railing itself can be predominantly aluminum however the tapered system can be machined out of 4140 steel, for example, for durability and longevity. All aluminum parts can be powder-coat painted with safety yellow, for example. The 4140 steel components of the tapered system can also be zinc plated and/or manufactured from stainless steel also for increased longevity; b) the present railing system can be offered as a complete system, including swing gates and storage racks for storage and transport; c) the present system is a railing system that has a tapered interface between the removable railing and the insert and/or receptacle that receives the railing. This tapered interface enables the railing to be installed into the receptacle at great angle(s); d) because the opening of the receptacle is larger at the top, the railing can be inserted into the receptacle easily (like a stick into a funnel) making the installation very easy and safe; e) the design of a tapered system allows for easy installations and gives a very solid stable railing with virtually no free play; f) incorporated into the railing/receptacle design is a locking system that is contained inside the railing and receptacle. The railing can be locked into the receptacle by means of a spring-loaded pin that automatically locks when the railing drops into the receptacle; g) the lock can be released by a handle situated under the lower rail making for a one-handed removal. This release mechanism can be modified for keyed and/or biometric operation to control the removal of the railings for greater security and safety; h) also designed into the system is a levelling tripod assembly (or "jig assembly") to aid in the installation of the receptacle. With the levelling tripod, it is possible to level the receptacle and have all railings installed dead level; i) having the railings level helps to eliminate railing sections from tilting ahead of other railing sections, therefore eliminating the safety risk of hooping and/or catching a protruding railing while passing either by walking or driving a vehicle or lift truck; j) etc.

Of course, and as can be easily understood by a person skilled in the art, the scope of the claims should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing from the scope and spirit of the present invention, as defined in the appended claims and as apparent to a person skilled in the art.

The invention claimed is:

1. An anchoring system for use with an erectable guiderail intended to be anchored with respect to a base surface, the anchoring system comprising:

a female component being positioned and sized for lodging into a corresponding hole provided about the base surface and about which the guiderail is intended to be anchored, the female component defining an elongated cavity having a longitudinal axis; and a male component being operatively mountable onto a corresponding portion of the guiderail and being securable therewith, the male component having an insertion portion being removably insertable into the elongated cavity of the female component;

wherein at least one of the male and female components is provided with at least one tapered surface, and wherein the male and female components of the anchoring system are shaped and sized with respect to one another so that a spacing tolerance between the male and female components decreases as the male component is inserted into the elongated cavity of the female component along the longitudinal axis thereof;

wherein the at least one tapered surface includes at least one main inner tapered surface provided about a main inner surface of the cavity of the female component, said at least one main inner tapered surface providing a first contact point for the male and female components of the anchoring system; and wherein the female component includes a casing defining the elongated cavity, and wherein the at least one main inner tapered surface is provided by at least one guiding surface being mountable onto the casing.

2. An anchoring system according to claim 1, wherein the anchoring system includes a first configuration where the spacing tolerance between the male and female components is above zero, and a second configuration where the spacing tolerance zero becomes zero resulting from at least one contact point occurring between the male and the female component; and wherein the male and female components are further shaped and sized with respect to one another so that the at least one contact point occurs upon the male component reaching a given length into the elongated cavity of the female component.

3. An anchoring system according to claim 2, wherein the male and female components are further shaped and sized with respect to one another so at least one upper contact point and at least one lower contact point are provided, between the male and female components, when the anchoring system is operated in the second configuration.

4. An anchoring system according to claim 1, wherein the at least one main inner tapered surface is at an angle of about 1° with respect to the longitudinal axis of the elongated cavity;

wherein the at least one tapered surface includes at least one upper inner tapered surface provided about a top inner surface of the cavity of the female component, said at least one upper inner tapered surface providing a second contact point for the male and female components of the anchoring system; and wherein the at least one upper inner tapered surface is at an angle of about 5° with respect to the longitudinal axis of the elongated cavity.

5. An anchoring system according to claim 1, wherein the at least one tapered surface includes at least one main body tapered surface provided about the insertion portion of the male component.

6. An anchoring system according to claim 1, wherein the at least one tapered surface includes at least one wedging body tapered surface provided about the male component.

7. An anchoring system according to claim 1, wherein the at least one main inner tapered surface is provided by at least one guiding bar.

8. An anchoring system according to claim 7, wherein the casing includes at least one lateral cutaway section, and wherein the at least one guiding bar is mountable onto the casing via the at least one lateral cutaway section of the casing.

9. An anchoring system according to according to claim 7, wherein the at least one guiding bar is securable in place onto the casing by means of welding.

10. An anchoring system according to claim 7, wherein the at least one guiding bar includes a pair of first and second guiding bars being mountable respectively onto first and second opposite sides of the casing;

wherein the first and second guiding bars are mountable respectively onto first and second lateral cutaway sections of the casing;

wherein the first and second guiding bars are securable respectively onto the first and second lateral cutaway sections of the casing by means of welding;

wherein the first and second lateral cutaway sections of the casing are positioned opposite to one another on the casing; and wherein the first and second lateral cutaway sections of the casing include a geometrical profile being complementary to that of the first and second guiding bars.

11. An anchoring system according to claim 10, wherein the first and second guiding bars include rectangular plates, and wherein the first and second lateral cutaway sections of the casing include a corresponding complementary rectangular profile;

wherein the first and second guiding bars are substantially identical to one another;

wherein a main body of the casing is substantially cylindrical;

wherein the first and second guiding bars are positioned, shaped and sized with respect to the casing so that side portions of said first and second guiding bars be present longitudinally inside the elongated cavity of the female component; and wherein the first and second guiding bars are further positioned, shaped and sized with respect to the casing so that top portions of said first and second guiding bars be used as first and second supporting portions for a corresponding top cap of the anchoring system.

12. An anchoring system according to claim 1, wherein the anchoring system includes a closing cap being further positioned, shaped and sized so as to selectively and sealingly cover an inlet of the elongated cavity;

wherein the closing cap is further provided with a corresponding seal;

wherein the corresponding seal includes an O-ring being mountable about a peripheral recess defined about the closing cap; and wherein the closing cap is further shaped and sized so as to flip over open with respect to the inlet of the elongated cavity upon pushing on a side of the closing cap deprived of an underlying supporting portion.

13. An anchoring system according to claim 1, wherein the female component includes a bottom cap being securable in place onto a bottom portion of the casing;

wherein the bottom cap includes an orifice configured for a receiving a corresponding nozzle of a device intended to insert setting material into the hole of the base surface where the female component is lodged, via the orifice of the bottom cap of the casing, so as to securely fix the female component in place inside the hole with the setting material to be cured; and wherein the orifice of the bottom cap is provided with threading for threadedly engaging the corresponding nozzle of the device intended to insert setting material into the hole of the base surface via the orifice of the bottom cap of the casing.

14. An anchoring system according to claim 1, wherein the anchoring system includes a locking mechanism for locking the male component is place with respect to the female component.

15. An anchoring system according to claim 14, wherein the locking mechanism includes a locking pin provided about a portion of the male component, and being operable between locked and unlocked configurations, where in the locked configuration, the locking pin is in abutment with a corresponding shouldering part of the female component, thereby preventing the male component from being removed from the female component, and where in the unlocked configuration, the locking pin is drawn away from the shouldering part of the female component, thereby allowing the male component to be removed from the female component;

wherein the locking pin is configured to be spring-loaded into the locked configuration by default;

wherein the locking pin is mountable onto first and second orifices of the male component;

wherein the first and second orifices of the male component are provided on opposite sides of the male component;

wherein the first orifice of the male component is smaller than the second orifice of the male component, and wherein a proximate portion of the locking pin being insertable into the first orifice of the male component has a cross-sectional profile being smaller than a corresponding cross-sectional profile of a distal portion of the locking pin being insertable into the second orifice of the male component;

wherein the locking mechanism includes a spring extending about the proximate portion of the locking pin, the spring having a first end operatively pushing onto an inner wall of the male component and a second end operatively pushing against a distal portion of the locking pin, in order to urge said locking pin into the locked configuration via the spring;

wherein the proximate portion of the locking pin is cylindrical, wherein the distal portion of the locking pin is cylindrical, and wherein the spring is coaxially mounted about the proximate portion of the locking pin;

wherein the locking pin is mountable onto the male component in a slanted manner; and wherein the locking mechanism includes an unlocking assembly being operatively connectable to the locking pin or enabling a user of the anchoring system to selectively operate the locking mechanism into the unlocked configuration.

16. An anchoring system according to claim 15, wherein the unlocking assembly includes a linking component having a first end operatively connectable to the locking pin, and configured such that an activation of the linking component overrides a spring-loaded effect of the locking mechanism and draws the locking pin into the unlocked configuration;

wherein the linking component has a second end being operatively connectable to a corresponding key-lock mechanism;

wherein the key-lock mechanism is selected from the group consisting of a mechanical key-lock mechanism, a biometric key-lock mechanism and an electromagnetic key-lock mechanism; and wherein the male component is a hollow male component, and includes an inner passage extending between opposite extremities of the male component, and wherein the linking component extends through the inner passage of the male component.

17. An anchoring system according to claim 15, wherein the male component includes an insertion tip provided with a rounded rim; and wherein the locking pin extends out from the rounded rim of the insertion tip of the male component.

18. An anchoring system according to claim 16, wherein the linking component includes a cable having a first end operatively mountable onto the locking pin, and configured such that a pulling action of the cable overrides a spring-loaded effect of the locking mechanism and draws the locking pin into the unlocked configuration; and wherein the first end of the cable is insertable into a corresponding transversal bore of the locking pin, and is provided with a corresponding distal plug.

19. An anchoring system for use with an erectable guiderail intended to be anchored with respect to a base surface, the anchoring system comprising:

a female component being positioned and sized for lodging into a corresponding hole provided about the base surface and about which the guiderail is intended to be anchored, the female component defining an elongated cavity having a longitudinal axis; and a male component being operatively mountable onto a corresponding portion of the guiderail and being securable therewith, the male component having an insertion portion being removably insertable into the elongated cavity of the female component;

wherein at least one of the male and female components is provided with at least one tapered surface, and wherein the male and female components of the anchoring system are shaped and sized with respect to one another so that a spacing tolerance between the male and female components decreases as the male component is inserted into the elongated cavity of the female component along the longitudinal axis thereof;

wherein the at least one tapered surface includes at least one main inner tapered surface provided about a main inner surface of the cavity of the female component, said at least one main inner tapered surface providing a first contact point for the male and female components of the anchoring system;

wherein the at least one main inner tapered surface is at an angle of about 1° with respect to the longitudinal axis of the elongated cavity;

wherein the at least one tapered surface includes at least one upper inner tapered surface provided about a top inner surface of the cavity of the female component, said at least one upper inner tapered surface providing a second contact point for the male and female components of the anchoring system; and wherein the at least one upper inner tapered surface is at an angle of about 5° with respect to the longitudinal axis of the elongated cavity.

20. An anchoring system for use with an erectable guiderail intended to be anchored with respect to a base surface, the anchoring system comprising:

a female component being positioned and sized for lodging into a corresponding hole provided about the base surface and about which the guiderail is intended to be anchored, the female component defining an elongated cavity having a longitudinal axis; and a male component being operatively mountable onto a corresponding portion of the guiderail and being securable therewith, the male component having an insertion portion being removably insertable into the elongated cavity of the female component;

wherein at least one of the male and female components is provided with at least one tapered surface, and wherein the male and female components of the anchoring system are shaped and sized with respect to one another so that a spacing tolerance between the male and female components decreases as the male component is inserted into the elongated cavity of the female component along the longitudinal axis thereof;

wherein the anchoring system includes a closing cap being further positioned, shaped and sized so as to selectively and sealingly cover an inlet of the elongated cavity;

wherein the closing cap is further provided with a corresponding seal;

wherein the corresponding seal is mountable about a peripheral recess defined about the closing cap; and wherein the closing cap is further shaped and sized so as to flip over open with respect to the inlet of the elongated cavity upon pushing on a side of the closing cap deprived of an underlying supporting portion.

* * * * *